US011592757B2

(12) United States Patent
Yamashita et al.

(10) Patent No.: US 11,592,757 B2
(45) Date of Patent: Feb. 28, 2023

(54) ELECTROPHOTOGRAPHIC DEVELOPER SET INCLUDING TONER AND POWDER ADHESIVE, AND METHOD FOR PRODUCING BONDED PRODUCT

(71) Applicant: CANON KABUSHIKI KAISHA, Tokyo (JP)

(72) Inventors: Shohei Yamashita, Tokyo (JP); Yuhei Terui, Shizuoka (JP); Koji Nishikawa, Shizuoka (JP); Tsutomu Shimano, Shizuoka (JP); Kohei Matsuda, Kanagawa (JP); Yuki Nishizawa, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/385,137

(22) Filed: Jul. 26, 2021

(65) Prior Publication Data

US 2022/0035264 A1 Feb. 3, 2022

(30) Foreign Application Priority Data

Jul. 31, 2020 (JP) ..... JP2020-130489

(51) Int. Cl.
*G03G 9/113* (2006.01)
*G03G 15/08* (2006.01)
(Continued)

(52) U.S. Cl.
CPC ..... *G03G 9/113* (2013.01); *G03G 9/08711* (2013.01); *G03G 9/08782* (2013.01);
(Continued)

(58) Field of Classification Search
CPC ..... G03G 9/113; G03G 9/08711; G03G 9/08782; G03G 9/08795; G03G 9/08797;
(Continued)

(56) References Cited

U.S. PATENT DOCUMENTS 7,260,354 B2 8/2007 Ishida
8,268,522 B2 9/2012 Kadokura et al.
(Continued)

FOREIGN PATENT DOCUMENTS

JP 2006-171607 A 6/2006
JP 2010-164828 A 7/2010
(Continued)

OTHER PUBLICATIONS

Terui et al., U.S. Appl. No. 17/385,118, filed Jul. 26, 2021.
(Continued)

*Primary Examiner* — Ryan D Walsh
(74) *Attorney, Agent, or Firm* — Venable LLP

(57) ABSTRACT

Provided is an electrophotographic developer set having a toner and a powder adhesive, wherein the toner comprises a thermoplastic resin A; the powder adhesive comprises a thermoplastic resin B and a wax A; the wax A has two or more ester groups in the molecule; the thermoplastic resin B has an ester group; and in a viscoelasticity measurement, with Gt'(100) (Pa) being a storage elastic modulus at 100° C. of the toner, and Gb'(100) (Pa) being a storage elastic modulus at 100° C. of the powder adhesive, Gb'(100) is $1.00\times10^5$ Pa or less, and Gt'(100)/Gb'(100) is 1.20 or more, as well as a method for producing a bonded product using the above electrophotographic developer set.

14 Claims, 12 Drawing Sheets

(51) Int. Cl.
*G03G 15/01* (2006.01)
*G03G 9/087* (2006.01)

(52) U.S. Cl.
CPC ..... *G03G 9/08795* (2013.01); *G03G 9/08797* (2013.01); *G03G 15/0126* (2013.01); *G03G 15/0822* (2013.01); *G03G 2215/00835* (2013.01)

(58) Field of Classification Search
CPC ..... G03G 15/0126; G03G 15/0822; G03G 2215/00835
See application file for complete search history.

(56) References Cited

U.S. PATENT DOCUMENTS

| | | | | |
|---|---|---|---|---|
| 9,377,705 | B2 | 6/2016 | Shimano et al. | |
| 9,857,711 | B2 | 1/2018 | Yoshida et al. | |
| 10,416,582 | B2 | 9/2019 | Nakagawa et al. | |
| 10,437,165 | B2 | 10/2019 | Shimano et al. | |
| 10,877,390 | B2 | 12/2020 | Shimano et al. | |
| 2006/0133871 | A1* | 6/2006 | Ishida | G03G 15/2064 399/341 |
| 2007/0281235 | A1* | 12/2007 | Ono | G03G 9/08795 528/271 |
| 2020/0183294 | A1 | 6/2020 | Fukudome et al. | |
| 2020/0310271 | A1* | 10/2020 | Sakamoto | G03G 15/0865 |
| 2022/0035261 | A1* | 2/2022 | Shimano | G03G 9/135 |
| 2022/0035262 | A1* | 2/2022 | Nishikawa | G03G 9/08755 |
| 2022/0035264 | A1* | 2/2022 | Yamashita | G03G 9/08797 |
| 2022/0282124 | A1* | 9/2022 | Yamawaki | C09J 125/14 |

FOREIGN PATENT DOCUMENTS

| | | | |
|---|---|---|---|
| JP | 2013-130794 | A | 7/2013 |
| JP | 2014-139618 | A | 7/2014 |

OTHER PUBLICATIONS

Nishikawa et al., U.S. Appl. No. 17/385,127, filed Jul. 26, 2021.
Shimano et al., U.S. Appl. No. 17/385,147, filed Jul. 26, 2021
JP 2006-171607, U.S. Pat. No. 7,260,354 B2.
JP 2010-164828, U.S. Pat. No. 8,268,522 B2.

* cited by examiner

ELECTROPHOTOGRAPHIC DEVELOPER SET INCLUDING TONER AND POWDER ADHESIVE, AND METHOD FOR PRODUCING BONDED PRODUCT

BACKGROUND OF THE INVENTION

Field of the Invention

The present disclosure relates to an electrophotographic developer set, which has a toner and a powder adhesive functioning as an adhesive, and with which an electrostatic latent image is developed on a recording material by using an electrophotographic system, to form a toner image and an adhesive portion by the powder adhesive. The present disclosure relates also to a method for producing a bonded product by using the above electrophotographic developer set.

Description of the Related Art

To produce paper bags on which information, which varies for each given individual, is printed by a printer or a copier, a method has conventionally been resorted to, in which a paper bag produced beforehand is set in a printer or copier, with printing being then performed on the paper bag. Simultaneous printing on a paper bag and on plain paper has been, therefore, problematic in terms of efforts required for the paper used in the printer to be changed from a paper bag to plain paper, and also in terms of mistaking a printing target, at every change of the printing target.

To address the above problems, a method has been proposed in which, in addition to image formation with colored toner by using an electrophotographic system, an adhesive portion derived from a pigment-free powder adhesive is also formed for paper bonding. A further method has been proposed in which printing on plain paper in accordance with the above method is simultaneously accompanied by processing of the plain paper into a paper bag. A toner set of a colored toner and a powder adhesive that are utilized in the above method has likewise been proposed.

In addition, a set of a colored toner and a transparent toner aimed at imparting a glossy feel and a three-dimensional appearance has likewise been proposed in applications other than adhesives.

Japanese Patent Application Publication No. 2006-171607 proposes an image forming method for forming an image and an adhesive portion by using an adhesive toner such that a lower-limit temperature of an appropriate fixing temperature of the adhesive toner is lower than that of a toner used for image formation.

Japanese Patent Application Publication No. 2010-164828 proposes a toner set in which gloss unevenness between an image portion and a non-image portion is reduced through the use of a transparent toner.

Japanese Patent Application Publication No. 2013-130794 proposes a toner set in which a layer of a transparent toner is formed on an image formed of a colored toner, to visually bring about a three-dimensional appearance.

Japanese Patent Application Publication No. 2014-139618 proposes a toner set for forming a color image having different glossiness on one image by using a transparent toner.

SUMMARY OF THE INVENTION

In the method disclosed in Japanese Patent Application Publication No. 2006-171607 an adhesive toner is used such that a lower-limit temperature of an appropriate fixing temperature of the adhesive toner is lower than that of toner for image formation, as a result the adhesive toner can be melted at a temperature at which the toner for image formation does not melt.

It has been found however that sufficient adhesive strength may fail to be obtained in this method in a case where an image portion of toner is formed on paper and an adhesive portion of a powder adhesive is formed on the back surface of the image portion, paper is then laid thereon with the adhesive portion facing inward, and the adhesive portion is melted, to thereby produce a paper bag.

It has been likewise found that upon sufficient heat melting of the adhesive portion for the purpose of achieving sufficient adhesive strength, a phenomenon (hot offset property) may occur in that the image portion melts and part of the image portion is transferred to a fixing unit, and thus it is difficult to achieve both sufficient adhesive strength and hot offset resistance.

Meanwhile, the toner sets disclosed in Japanese Patent Application Publication Nos. 2010-164828, 2013-130794 and 2014-139618 are aimed at achieving a three-dimensional appearance or glossy feel of a transparent tone, and accordingly are problematic in that it is difficult to achieve both sufficient adhesive strength and hot offset resistance of a colored toner in a case where a transparent toner is used as a powder adhesive.

The present disclosure provides an electrophotographic developer set that includes a toner and a powder adhesive, the set being excellent in hot offset resistance and affording sufficient adhesive strength, and provides a method for producing a bonded product using the electrophotographic developer set.

The present disclosure relates to an electrophotographic developer set comprising a toner, and a powder adhesive, wherein the toner comprises a thermoplastic resin A, the powder adhesive comprises a thermoplastic resin B and a wax A, the wax A has two or more ester groups in a molecule, the thermoplastic resin B has an ester group, and in a viscoelasticity measurement, with Gt'(100) (Pa) being a storage elastic modulus at 100° C. of the toner, and Gb'(100) (Pa) being a storage elastic modulus at 100° C. of the powder adhesive, Gb'(100) is $1.00\times10^5$ Pa or less, and Gt'(100)/Gb'(100) is 1.20 or more.

In addition, the present disclosure relates to a method for producing a bonded product resulting from bonding at least one sheet of paper via an adhesive portion by using an electrophotographic developer set, wherein the electrophotographic developer set comprises a toner, and a powder adhesive, the toner comprises a thermoplastic resin A, the powder adhesive comprises a thermoplastic resin B and a wax A, the wax A has two or more ester groups in a molecule, the thermoplastic resin B has an ester group, and in a viscoelasticity measurement, with Gt'(100) (Pa) being a storage elastic modulus at 100° C. of the toner, and Gb'(100) (Pa) being a storage elastic modulus at 100° C. of the powder adhesive, Gb'(100) is $1.00\times10^5$ Pa or less, and Gt'(100)/Gb'(100) is 1.20 or more, wherein the bonded product has a surface A on which an adhesive portion of the powder adhesive is fixed, and a surface B on which a toner image portion of the toner is fixed, the surface B being a surface different from the surface A, wherein the method comprises the following steps, in no particular order:

forming the toner image portion on the surface B, and fixing the toner image portion on the surface B by heating; and forming the adhesive portion on the surface A, and fixing the adhesive portion on the surface A by heating, and wherein the method further comprises the following steps, after formation and fixation of the toner image portion and the adhesive portion, overlaying the paper so as to interpose the adhesive portion, and melting the adhesive portion thereby bonding the paper to obtain the bonded product.

According to the present disclosure, an electrophotographic developer set that includes a toner and a powder adhesive, the set being excellent in hot offset resistance and affording sufficient adhesive strength, and a method for producing a bonded product using the electrophotographic developer set can be provided.

Further features of the present invention will become apparent from the following description of exemplary embodiments with reference to the attached drawings.

DESCRIPTION OF THE EMBODIMENTS

Figure 1:
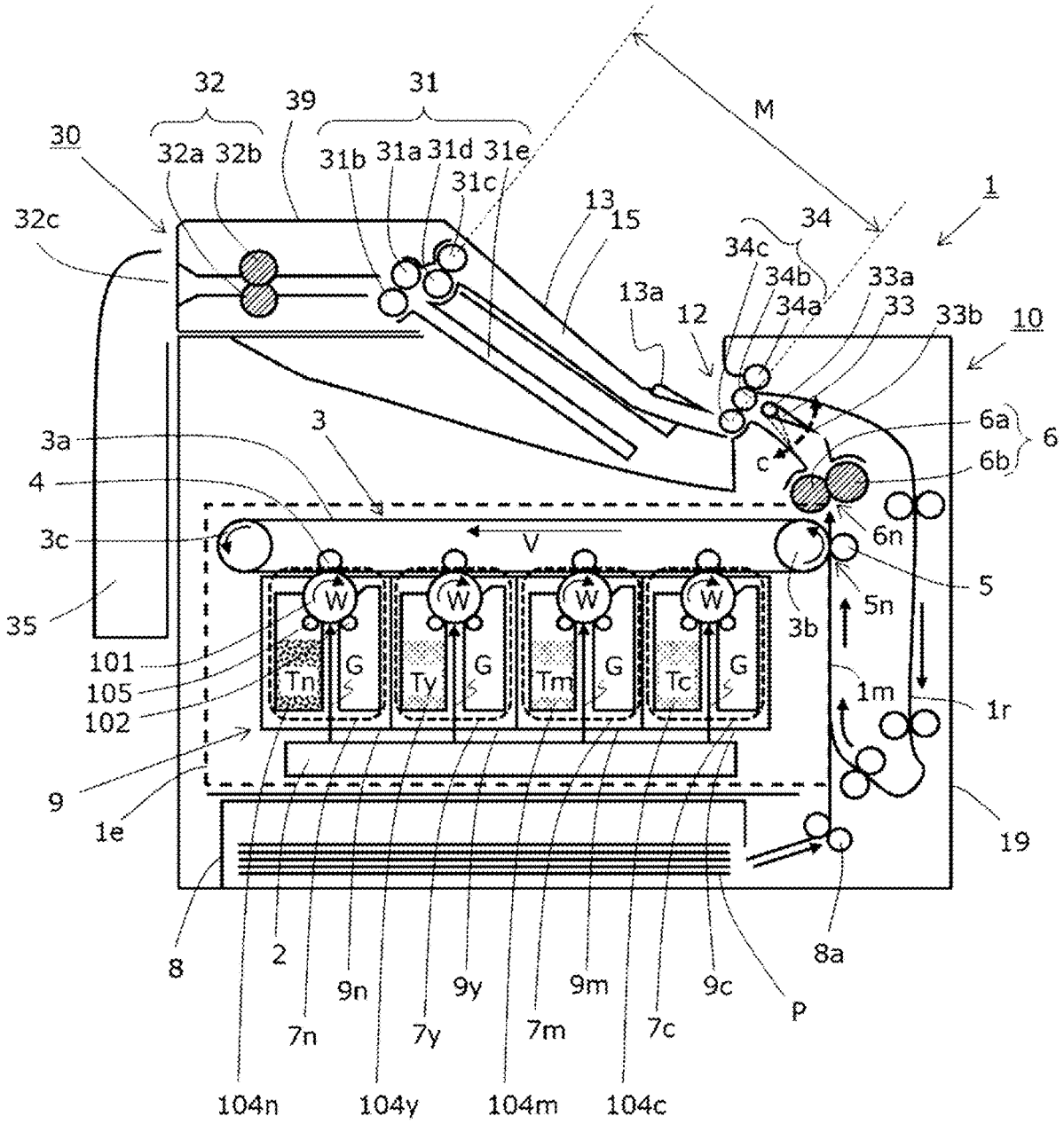
FIG. 1 is a schematic diagram of an image forming apparatus.

In the present disclosure the notations "from XX to YY" and "XX to YY" representing a numerical value range denote, unless otherwise stated, a numerical value range that includes the lower limit and the upper limit thereof, as endpoints.

In a case where numerical value ranges are described in stages, the upper limits and the lower limits of the respective numerical value ranges can be combined arbitrarily.

Methods for measuring various physical properties will be described further on.

The reference symbols in the drawings are as follows:

1 . . . image forming apparatus; 1*e* . . . image forming means (image forming unit); 1*m* . . . main transport path; 2 . . . scanner unit; 3 . . . transfer unit; 3*a* . . . transfer belt; 3*b* . . . secondary transfer inner roller; 3*c* . . . tension roller; 4 . . . primary transfer roller; 5 . . . transfer means (secondary transfer roller); 5*n* . . . transfer nip; 6 . . . fixing means (first fixing unit); 6*a* . . . heat roller; 6*b* . . . pressure roller; 6*n* . . . fixing nip; 7*n* . . . second process unit (process cartridge); 7*y*, 7*m*, 7*c* . . . first process unit (process cartridge); 8 . . . sheet cassette; 8*a* . . . transport roller; 9 . . . cartridge support portion; 10 . . . apparatus body; 12 . . . discharge port (first discharge port); 13 . . . guide member (first discharge tray); 13*a* . . . tray switching guide; 15 . . . intermediate path; 19 . . . first housing; 20 . . . openable/closable tray;

30 . . . sheet processing device (post-processing unit); 31 . . . folding means (folding device); 31*a* . . . first folding roller; 31*b* . . . second folding roller; 31*c* . . . first guide roller; 31*d* . . . second guide roller; 31*e* . . . draw-in portion; 31*f* . . . guide wall; 31*g* . . . wall; 31*h* . . . end portion; 32 . . . bonding means (second fixing unit); 33 . . . switching guide; 33*a* . . . shaft portion; 33*b* . . . switching guide tip; 34 . . . discharge unit; 34*a* . . . first discharge roller; 34*b* . . . intermediate roller; 34*c* . . . second discharge roller; 35 . . . second discharge tray; 36, 37 . . . connector; 39 . . . second housing;

51 . . . pay slip; 52 . . . medicine bag; 51*a* . . . entire circumference of outer periphery; 51*b*, 52*b* . . . folding crease at middle; 52*a* . . . C-shaped region;

101 . . . photosensitive drum; 102 . . . charging roller; 103 . . . cleaning member; 104*n*, 104*y*, 104*m*, 104*c* . . . powder accommodating portion; 105 . . . developing roller; 106 . . . developer supply roller; 107 . . . developing blade; 108 . . . stirring member; 109 . . . developing chamber;

P . . . sheet; R1 . . . first route; R2 . . . second route; Tn . . . powder adhesive; Ty, Tm, Tc . . . printing toner; CC . . . photosensitive member unit; DT . . . developing unit; q . . . tip of sheet P; r . . . middle portion; L . . . total length of sheet P; M . . . spacing; and N . . . depth of draw-in portion.

Firstly, an example will be explained below of a method for producing a paper bag by an electrophotographic system, using an electrophotographic developer set that contains the above toner and powder adhesive.

A toner image portion of toner is first formed on paper using an electrophotographic system (forming step of the toner image portion). The toner image portion is next fixed to the paper by heating (fixing step of the toner image portion). Next, an adhesive portion by a powder adhesive is formed (forming step of the adhesive portion) on the back surface of the paper having the toner image portion formed thereon. Subsequently, the toner image portion is fixed on the paper by heating (fixing step of the adhesive portion). Thereafter, the paper is laid up, in an overlapping fashion, so as to sandwich the adhesive portion, with further heating, to thereby elicit bonding (bonding step) through melting of the adhesive portion, and yield a paper bag (deliverable).

In order to preclude peeling of the adhesive portion even when an article is placed into the deliverable it is important to increase adhesiveness between the powder adhesive and paper, but it is necessary, at the same time, to prevent hot offset in the toner image portion.

The inventors conducted diligent research based on the idea that it is important to control the melt viscosity of the powder adhesive and of the toner, in order to achieve sufficient adhesiveness of the adhesive portion in the bonding step and, at the same time, prevent hot offset in the toner image portion.

The present disclosure is an electrophotographic developer set containing a toner and a powder adhesive, wherein the toner contains a thermoplastic resin A; the powder adhesive contains a thermoplastic resin B and a wax A; the wax A has two or more ester groups in the molecule; the thermoplastic resin B has an ester group; in a viscoelasticity measurement, with Gt'(100) (Pa) as the storage elastic modulus at 100° C. of the toner, and Gb'(100) (Pa) as the storage elastic modulus at 100° C. of the powder adhesive, Gb'(100) is $1.00\times10^5$ Pa or less, and Gt'(100)/Gb'(100) is 1.20 or more.

By controlling the physical properties of the developer set so as to lie within the above range it becomes possible to achieve both sufficient adhesiveness and offset resistance. The inventors surmise the following concerning the underlying reasons for this.

The adhesive portion in the bonding step cannot receive heat directly from the fixing unit on account of the presence of paper between the adhesive portion and the fixing unit. It is therefore necessary to design the powder adhesive so as to have a viscosity that allows for sufficient melting even if the heat of the fixing unit is partially blocked by paper.

Furthermore, in order for the powder adhesive to bring out strong adhesiveness it is important to design the powder adhesive not only so that an adhesive portion of the powder adhesive is formed as an image on the paper, but also so that the powder adhesive penetrates the paper fibers when melted. Penetration of the melted powder adhesive into the paper fibers and ensuing hardening of the powder adhesive give rise to a so-called anchor effect thanks to which adhesiveness can be improved. In order to obtain adhesiveness, specifically, it is important that viscosity drops quickly and that the powder adhesive gets into the paper fibers at the time of melting.

The powder adhesive contains the thermoplastic resin B having an ester group and the wax A having two or more ester groups in the molecule. Compatibility of the wax A with the thermoplastic resin B is increased thanks to the interaction between the ester group of the thermoplastic resin B and the ester groups of the wax A. As a result, the heat-melted wax A blends instantly into the thermoplastic resin B, whereby the viscosity of the powder adhesive is reduced rapidly (sharp melt property). In consequence, the powder adhesive can melt promptly also during passage through the fixing unit. Further, the ester groups of the wax A interact with the hydroxyl groups of cellulose, which is the main starting material of paper, at the time of melting, so that the wax A penetrates readily into the paper fibers.

From these viewpoints, the wax A contained in the powder adhesive has two or more ester groups in the molecule. When two or more ester groups are present in the molecule of the wax A, the compatibility of the wax A with the thermoplastic resin B and the permeability of wax A into paper are both enhanced as a result, and superior adhesiveness can thus be obtained.

In order to suppress excessive compatibility of the wax A with the thermoplastic resin B and excessive permeation of the wax A into paper, the number of ester groups in the molecule of the wax A is preferably from 2 to 4, more preferably from 2 to 3, and is yet more preferably 2.

In a viscoelasticity measurement of the powder adhesive, moreover, the storage elastic modulus at 100° C. of the powder adhesive, Gb'(100), is herein $1.00\times10^5$ Pa or less.

It has been found that the powder adhesive must be designed to have a viscosity that allows the powder adhesive to melt even if heat from the fixing unit is partially blocked by paper, and that not only the viscosity at the time of melting but also the storage elastic modulus at 100° C. is important in order to achieve adhesive strength. The storage elastic modulus, which is an index of ease of deformability, has property whereby the smaller the value of the storage elastic modulus, the harder it is for a deformed shape to revert to the original shape.

When Gb'(100) is $1.00\times10^5$ Pa or less, the powder adhesive having melted on account of heat can penetrate between paper fibers, as deformation progresses when pressure is applied, and hence sufficient adhesive strength is obtained. Preferably, Gb'(100) is $1.00\times10^4$ Pa or less. The lower limit is not particularly restricted, and is preferably 1.00×10 Pa or more, and more preferably $1.00\times10^2$ Pa or more.

Herein it is necessary to suppress the occurrence of hot offset in a toner image portion formed on the front side of the paper bag, while achieving sufficient adhesive strength of the powder adhesive. The toner image section receives heat directly, given the absence of shielding between the toner image portion and the fixing unit. Therefore, excessive deformation of the toner by heat and pressure results in migration of part of the toner to the fixing unit, giving rise to hot offset.

With Gt'(100) as the storage elastic modulus at 100° C. of the toner in a viscoelasticity measurement of the toner, it is important that the Gt'(100) of the toner be set, with respect to the Gb'(100) which is the index of deformation of the powder adhesive on account of heat and pressure by the fixing unit, so as to lie in a range such that deformation on account of heat and pressure by the fixing unit is not excessive.

Diligent studies by the inventors have revealed that if Gt'(100)/Gb'(100) is 1.20 or higher, it is possible to achieve both sufficient adhesive strength of the powder adhesive and hot offset resistance of the toner. Herein Gt'(100)/Gb'(100) is preferably from 2.00 to 30.00, more preferably from 3.00 to 30.00.

Superior adhesiveness and hot offset resistance of an image, which are the goal of the present disclosure, could thus be achieved for the first time by controlling the composition of the powder adhesive and, simultaneously, controlling differences in physical properties between the toner and the powder adhesive.

Herein Gb'(100) and Gt'(100) can be controlled on the basis of the types and amount ratios of the thermoplastic resins and/or waxes contained in the powder adhesive and in the toner.

Preferably, Gt'(100) is from $5.00\times10^3$ Pa to $2.00\times10^5$ Pa, more preferably from $2.50\times10^4$ Pa to $1.50\times10^5$ Pa.

In terms of compatibility of the wax A with the thermoplastic resin B and permeability into paper, the wax A preferably has molecular weight of 300 to 1000, more preferably from 300 to 800. When the molecular weight of the wax lies in the above ranges, the density of ester groups in the molecules of the wax A increases. Compatibility with the thermoplastic resin B and permeability into paper are enhanced as a result, and better adhesiveness can be obtained.

A compound having a molecular weight of 3000 or less and an endothermic peak of 80 J/g or more as measured by differential scanning calorimetry (DSC) is defined as a wax in the present disclosure.

The wax A preferably contains at least one selected from the group consisting of an ester wax represented by Formula (1) and an ester wax represented by Formula (2) below.

(1)

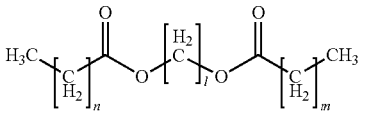

(2)

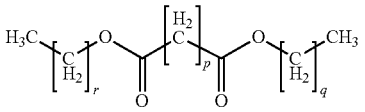

In the formulae, l represents a positive integer from 2 to 12 (preferably from 2 to 8), and n and m each independently represents a positive integer from 12 to 20 (preferably from 14 to 20). Further, p represents a positive integer from 2 to 10 (preferably from 2 to 8), and q and r each independently represents a positive integer from 11 to 21 (preferably from 14 to 21).

The ester wax represented by Formula (1) and the ester wax represented by Formula (2) exhibit close positions of the ester groups in the molecule, and hence interactions with the hydroxyl groups of cellulose contained in paper are strong, so that stronger adhesiveness can be achieved.

It is deemed that the powder adhesive, which arguably receives heat through paper, unlike toner that does so directly from the fixing unit, readily loses thermal energy in the bonding step, thus hindering melting. However, the wax A in the powder adhesive contains an ester wax represented by Formula (1) or an ester wax represented by Formula (2), and accordingly the affinity with the cellulose in the paper is high, and likewise permeation of the wax A into the paper is high. As a result, loss of thermal energy is suppressed and stronger adhesiveness can be achieved.

The ester wax represented by Formula (1) and the ester wax represented by Formula (2) have a linear structure, and hence crystallize readily and exhibit a high degree of crystallinity in the powder adhesive. A powder adhesive of excellent durability can be accordingly obtained, such that contamination of a developing member or the like is unlikely to occur, even in mass printing.

From the above it follows that a toner combining adhesiveness and durability at a higher level can be achieved by virtue of the fact that the wax A in the powder adhesive contains at least one selected from the group consisting of ester wax represented by Formula (1) and ester wax represented by Formula (2).

More preferably, the wax A is a compound represented by Formula (1) of which l represents 2, and n and m each independently represents a positive integer of 14 to 20. More preferably, the wax contained in the powder adhesive contains the ester wax represented by Formula (1), and in Formula (1), l represents 2, and n and m each independently represents a positive integer of 14 to 20.

When l represents 2 and n and m each independently represents a positive integer of 14 to 20 in Formula (1), the positions of the two ester groups in the molecule are close to each other, and accordingly the wax crystallizes yet more readily, and a powder adhesive of yet higher durability can be obtained. Preferably, n and m are each independently from 16 to 20; more preferably n and m both are from 16 to 20.

Preferably, the powder adhesive further contains a wax B, which is a linear saturated hydrocarbon wax having a peak carbon number from 20 to 70 (preferably from 30 to 60). The linear saturated hydrocarbon wax (wax B) crystallizes faster than the wax A, and acts as a crystal nucleating agent in the wax A. As a result the crystallinity of the wax A is increased, and a powder adhesive of yet better storability can be obtained. Given that the wax B acts as a crystal nucleating agent in the wax A, crystals of the wax A having the wax B as the nuclei are therefore predominant in the powder adhesive. In consequence, hydrophobic interactions between the wax B and the wax A translate into a yet higher degree of crystallinity, and storability can be further improved.

On account of the higher crystallization rate of the wax A, moreover, the wax A crystallizes and the resin solidifies quickly also during paper bonding after melting, thanks to which a stronger adhesive strength can be obtained.

Herein the peak carbon number is a value resulting from dividing a peak value of molecular weight of the linear saturated hydrocarbon, obtained in a molecular weight measurement, by 14, which is the formula mass of $CH_2$.

The content N of the wax A in the powder adhesive is preferably from 6.0 mass % to 18.0 mass %. When the content N of the wax A lies in the above range it is possible to suppress excessive compatibility of the wax A with the thermoplastic resin B, while maintaining the sharp melt property of the powder adhesive. As a result the wax A is less likely to exude on the surface layer of powder adhesive particles, while excellent adhesiveness is maintained, and thus a powder adhesive having yet superior storability can be obtained.

The content N of the wax A in the powder adhesive is preferably from 8.0 mass % to 17.0 mass %, more preferably from 10.0 mass % to 15.0 mass %.

The content of the wax B in the powder adhesive is preferably from 0.1 mass % to 5.0 mass %, more preferably from 0.5 mass % to 3.0 mass %.

When the toner further contains a wax, a ratio Nb/Na lies preferably in the range from 0.80 to 6.00, where Na (mass %) denotes the content of total wax in the toner and Nb (mass %) denotes the content of total wax in the powder adhesive.

Herein setting Nb/Na to be 0.80 or higher signifies that the amount of wax contained in the powder adhesive is larger than the amount of wax contained in the toner, or is not too small an amount. Hence, the endothermic quantity of the toner can be made smaller than the endothermic quantity of the powder adhesive. Therefore, the heat imparted by the fixing unit in the bonding step is robbed less readily during melting of the toner, and melting of the powder adhesive is less likely to be hindered. As a result it becomes possible to promote a rapid reduction in the viscosity of the powder adhesive and to obtain a stronger adhesive strength with paper.

By setting Nb/Na to be 6.00 or less the amount of heat robbed at the time of melting of the powder adhesive increases and toner melting is hindered, so that in consequence offset on the high temperature side is suppressed. Hot offset resistance and strong adhesive strength can be achieved at a higher level as a result.

More preferably, Nb/Na lies in the range from 0.80 to 2.50.

The wax used in the toner is not particularly limited, and known waxes can be used. Concrete examples of the wax include the following.

Hydrocarbon waxes (for instance petroleum waxes and derivatives thereof such as paraffin wax, microcrystalline wax and petrolatum; montan wax and derivatives thereof; hydrocarbon waxes and derivatives thereof obtained in accordance with the Fischer-Tropsch method; and polyolefin waxes and derivatives thereof such as polyethylene and polypropylene); natural waxes and derivatives thereof such as carnauba wax and candelilla wax; as well as ester waxes.

The term derivative encompasses herein oxides, block copolymers with vinylic monomers, and graft-modified products.

Preferably, the wax contained in the toner is at least one selected from the group consisting of hydrocarbon waxes and ester waxes.

As the ester wax there can be used a monoester compound containing one ester bond per molecule, and a diester compound containing two ester bonds per molecule, and also multifunctional ester compounds such as tetrafunctional ester compounds containing four ester bonds per molecule and hexafunctional ester compounds containing six ester bonds per molecule.

Preferably among the foregoing, the ester wax contains at least one compound selected from the group consisting of monoester compounds and diester compounds.

Concrete examples of monoester compounds include waxes having a main component in the form of a fatty acid ester, such as carnauba wax and montanate ester wax; waxes obtained by deacidifying part or the entirety of an acid component from a fatty acid ester, such as deacidified carnauba wax; waxes obtained through hydrogenation of vegetable oils; methyl ester compounds having a hydroxyl group; and saturated fatty acid monoesters such as stearyl stearate and behenyl behenate.

Concrete examples of diester compounds include dibehenyl sebacate, nonanediol dibehenate, terephthalate behenate, stearyl terephthalate and ethylene glycol distearate. The wax may contain other known waxes, besides the above compounds. The wax may be used as a single type alone; alternatively, two or more types may be used concomitantly.

A further concrete example of a hydrocarbon wax is for instance HNP-9 by Nippon Seiro Co., Ltd.

The resins that can be used as the thermoplastic resins A, B are not particularly limited.

For instance there can be used known thermoplastic resins such as polyester resins, vinyl resins, acrylic resins, styrene acrylic resins, polyethylene, polypropylene, polyolefins, ethylene-vinyl acetate copolymer resins, and ethylene-acrylic acid copolymer resins. The thermoplastic resins A, B may contain a plurality of these resins. The thermoplastic resin A and the thermoplastic resin B may be identical or different.

Preferably, the thermoplastic resins A, B are each independently a polyester resin or a styrene acrylic resin, more preferably a styrene acrylic resin. Preferably, the thermoplastic resins A, B each independently contain at least one selected from the group consisting of polyester resins and styrene acrylic resins, and more preferably contain a styrene acrylic resin. The content of the styrene acrylic resin in the thermoplastic resin A is preferably from 50 mass % to 100 mass %, more preferably from 80 mass % to 100 mass %, and yet more preferably from 90 mass % to 100 mass %. The content of the styrene acrylic resin in the thermoplastic resin B is preferably from 50 mass % to 100 mass %, more preferably from 80 mass % to 100 mass %, and yet more preferably from 90 mass % to 100 mass %.

A known polyester resin can be used as the above polyester resin.

Concrete examples thereof include condensation polymers of dibasic acids and derivatives thereof (carboxylic acid halides, esters or acid anhydrides), and divalent alcohols. Trivalent or higher polybasic acids and derivatives thereof (carboxylic acid halides, esters or acid anhydrides), monobasic acids, trihydric or higher alcohols, and monohydric alcohols may also be used, as needed.

Examples of dibasic acids include aliphatic dibasic acids such as maleic acid, fumaric acid, itaconic acid, oxalic acid, malonic acid, succinic acid, dodecyl succinic acid, dodecenyl succinic acid, adipic acid, azelaic acid, sebacic acid and decane-1,10-dicarboxylic acid; and aromatic dibasic acids such as phthalic acid, tetrahydrophthalic acid, hexahydrophthalic acid, tetrabromophthalic acid, tetrachlorophthalic acid, HET acid, himic acid, isophthalic acid, terephthalic acid and 2,6-naphthalenedicarboxylic acid.

Examples of derivatives of dibasic acids include carboxylic acid halides, esters and acid anhydrides of the aliphatic dibasic acids and aromatic dibasic acids above.

Examples of dihydric alcohols include acyclic aliphatic diols such as ethylene glycol, 1,2-propanediol, 1,3-propanediol, 1,4-butanediol, 1,5-pentanediol, 1,6-hexanediol, diethylene glycol, dipropylene glycol, triethylene glycol and neopentyl glycol; bisphenols such as bisphenol A and bisphenol F; alkylene oxide adducts of bisphenol A such as bisphenol A ethylene oxide adducts and bisphenol A propylene oxide adducts; and aralkylene glycols such as xylylene diglycol.

Examples of trivalent or higher polybasic acids and anhydrides thereof include trimellitic acid, trimellitic anhydride, pyromellitic acid and pyromellitic anhydride.

Examples of polymerizable monomers capable of forming the above styrene acrylic resins include styrenic monomers such as styrene, α-methylstyrene and divinylbenzene; unsaturated carboxylic acid esters such as methyl acrylate, butyl acrylate, methyl methacrylate, 2-hydroxyethyl methacrylate, t-butyl methacrylate and 2-ethylhexyl methacrylate; unsaturated carboxylic acids such as acrylic acid and methacrylic acid; unsaturated dicarboxylic acids such as maleic acid; unsaturated dicarboxylic acid anhydrides such as maleic acid anhydride; nitrile-based vinyl monomers such as acrylonitrile; halogen-containing vinyl monomers such as vinyl chloride; and nitro-based vinyl monomers such as nitrostyrene. The foregoing can be used singly or in combinations of a plurality of types.

The unsaturated carboxylic acid ester is preferably an alkyl (meth)acrylate ester the alkyl group whereof has from 1 to 8 (more preferably from 2 to 6) carbon atoms. Preferably, the styrene acrylic resin is a copolymer of styrene and an alkyl (meth)acrylate ester the alkyl group whereof has from 1 to 8 (more preferably from 2 to 6) carbon atoms.

The content ratio of the thermoplastic resin B in the powder adhesive is preferably from 60 mass % to 90 mass %. The content ratio of the thermoplastic resin A in the toner is preferably from 60 mass % to 90 mass %.

The ester group concentration in the thermoplastic resin B is preferably from 1.00 mmol/g to 7.00 mmol/g, more preferably from 1.50 mmol/g to 5.00 mmol/g. A concentration lying within the above range signifies that the thermoplastic resin B contains an ester group, and that the interactions of the wax A with the ester group lie within an appropriate range in the present disclosure.

That is, the compatibility of the wax A with the thermoplastic resin B can be further increased by virtue of the fact that the ester group concentration of the thermoplastic resin B is 1.00 mmol/g or more. As a result, the wax A instantly melts into the thermoplastic resin B at the time of melting, whereby the viscosity drops rapidly, and a powder adhesive of yet better adhesiveness is obtained.

Further, excessive compatibility of the wax A with the thermoplastic resin B can be suppressed by virtue of the fact that the ester group concentration of the thermoplastic resin B is 7.00 mmol/g or less. As a result, the wax A does not readily exude to the surface layer of the particles of the powder adhesive, and a powder adhesive of yet better storability can be obtained.

The ester group concentration of the thermoplastic resin B can be controlled on the basis of the type and the amount ratio of the monomers used in the thermoplastic resin B.

With A as the peak molecular weight of a main peak in a molecular weight distribution of a tetrahydrofuran-soluble fraction of the toner, and B as the peak molecular weight of a main peak in a molecular weight distribution of a tetrahydrofuran-soluble fraction of the powder adhesive, a ratio B/A lies preferably in the range from 0.50 to 2.00, more preferably from 0.70 to 1.50.

Herein B/A lying in the above ranges signifies that the peak molecular weights of the toner and of the powder adhesive are close to each other. By bringing the peak molecular weights of the toner and of the powder adhesive to be close to each other, the molten states of the foregoing in the bonding step can likewise be brought close to each other, so that the effect of the present disclosure can be elicited readily as a result. The above peak molecular weights can be controlled on the basis of the production conditions of the thermoplastic resin A of the toner and the thermoplastic resin B of the powder adhesive.

A peak molecular weight A of the main peak in a molecular weight distribution of the tetrahydrofuran-soluble fraction of the toner is preferably from 10000 to 40000. Further, a peak molecular weight B of the main peak in the tetrahydrofuran-soluble fraction of the powder adhesive is preferably from 10000 to 40000.

The toner may contain a colorant. Examples of the colorant include black colorants, yellow colorants, magenta colorants and cyan colorants.

Examples of black colorants include carbon black.

Examples of yellow colorants on include yellow pigments typified for instance by monoazo compounds; disazo compounds; condensed azo compounds; isoindolinone compounds; isoindoline compounds; benzimidazolone compounds; anthraquinone compounds; azo metal complexes; methine compounds; and allylamide compounds. Concrete examples include C.I. Pigment Yellow 74, 93, 95, 109, 111, 128, 155, 174, 180 and 185.

Examples of magenta colorants include magenta pigments typified for instance by monoazo compounds; condensed azo compounds; diketopyrrolopyrrole compounds; anthraquinone compounds; quinacridone compounds; base dye lake compounds; naphthol compounds; benzimidazolone compounds; thioindigo compounds; and perylene compounds. Concrete examples include C.I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 238, 254 and 269; and C.I. Pigment Violet 19.

Examples of cyan colorants include cyan pigments for instance typified by copper phthalocyanine compounds and derivatives thereof; anthraquinone compounds; and basic dye lake compounds. Concrete examples include C.I. Pigment Blue 1, 7, 15, 15:1, 15:2, 15:3, 15:4, 60, 62 and 66.

Various dyes conventionally known as colorants can also be used together with these pigments.

The content of the colorant in the toner is preferably from 1.0 mass % to 20.0 mass %.

The powder adhesive may contain a colorant. Examples of the colorant include the colorants illustrated above.

The content of the colorant in the powder adhesive is preferably from 0.0 mass % to 1.0 mass %, more preferably from 0.0 mass % to 0.2 mass %.

The toner may contain known materials such as a charge control agent, a charge control resin, and a pigment dispersing agent, as needed. The powder adhesive may contain known materials such as a charge control agent, a charge control resin, and a pigment dispersing agent, as needed.

The toner may be mixed, as needed, with an external additive or the like so that the external additive or the like becomes adhered to the surface of the toner. The powder adhesive may be mixed, as needed, with an external additive or the like so that the external additive or the like becomes adhered to the surface of the powder adhesive.

Examples of the external additive include inorganic fine particles selected from among silica fine particles, alumina fine particles and titania fine particles, and complex oxides of the foregoing. Examples of the complex oxides include silica aluminum fine particles and strontium titanate fine particles.

The content of the external additive in the toner is preferably from 0.01 mass % to 10.0 mass %, more preferably from 0.1 mass % to 4.0 mass %.

The content of the external additive in the powder adhesive is preferably from 0.01 mass % to 10.0 mass %, more preferably from 0.1 mass % to 4.0 mass %.

The absolute value of the difference between the content of the external additive in the toner and the content of the external additive in the powder adhesive is preferably from 0.0 mass % to 2.5 mass %, more preferably from 0.0 mass % to 2.0 mass %. The ratio of the content of the external additive in the toner and the content of the external additive in the powder adhesive (content of external additive in toner: content of external additive in powder adhesive) is preferably from 1.0:8.0 to 8.0:1.0, more preferably from 1.0:4.0 to 4.0:1.0, and yet more preferably from 1.0:2.0 to 2.0:1.0.

The glass transition temperature (Tg) of the toner is preferably from 45° C. to 60° C. The glass transition temperature (Tg) of the powder adhesive is preferably from 45° C. to 60° C. Within the above ranges, the foregoing can be suitably used in electrophotographic processes, and the effect of the present disclosure can be brought out at a higher level.

Preferably, the difference between the Tg of the toner and the Tg of the powder adhesive is from 0° C. to 10° C. By virtue of the fact that the Tg of the toner and the powder adhesive is from 0° C. to 10° C., the molten states of the foregoing in the bonding step can be brought close to each other, and as a result the effect of the present disclosure can be readily elicited. The Tg of the toner and the powder adhesive can be controlled on the basis of the types and amount ratios of the monomers used for the thermoplastic resins of the toner and the powder adhesive, and on the basis of the type and amount ratio of the waxes that are used.

The weight-average particle diameter (D4) of the toner is preferably from 4.0 μm to 15.0 μm. Within the above range, the molten state in the bonding step can be made uniform, and as a result a toner exhibiting less print transfer can be obtained. The weight-average particle diameter (D4) of the powder adhesive is preferably from 4.0 μm to 20.0 μm. Within the above range, the thickness of an adhesive portion can be made sufficiently large while the molten state in the bonding step is rendered uniform, so that a stronger adhesive strength can be achieved as a result.

Preferably, the absolute value of the difference between the weight-average particle diameter (D4) of the toner and the weight-average particle diameter (D4) of the powder adhesive in the present disclosure is from 0.0 μm to 5.0 μm. By virtue of the fact that the absolute value of the difference between the weight-average particle diameter (D4) of the toner and the weight-average particle diameter (D4) of the powder adhesive is from 0.0 μm to 5.0 μm, the molten states of the foregoing in the bonding step can be brought close to each other, and as a result the effect of the present disclosure can be readily elicited. The weight-average particle diameter (D4) of the toner and the weight-average particle diameter (D4) of the powder adhesive can be controlled on the basis of the method for producing the toner and the method for producing the powder adhesive.

The method for producing the toner in the present disclosure is not particularly limited, and the toner can be produced in accordance with a known production method such as pulverization, suspension polymerization, emulsification aggregation or dissolution suspension.

A concrete explanation follows next on examples of an image forming apparatus and a processing device for performing a paper bonding process and in which an electrophotographic developer that contains a toner and a powder adhesive can be suitably used.

Overall Apparatus Configuration

Firstly, the overall configuration of the image forming apparatus will be explained with reference to FIG. 1, FIG. 2 and FIG. 5. FIG. 1 is a schematic diagram illustrating the cross-sectional configuration of an image forming apparatus 1 that includes an image forming apparatus body (hereafter referred to as apparatus body 10) and a post-processing unit 30 connected to the apparatus body 10. The image forming apparatus 1 is an electrophotographic image forming apparatus (electrophotographic system) made up of the apparatus body 10 having an electrophotographic printing mechanism, and the post-processing unit 30 as a sheet processing device.

Figure 5:
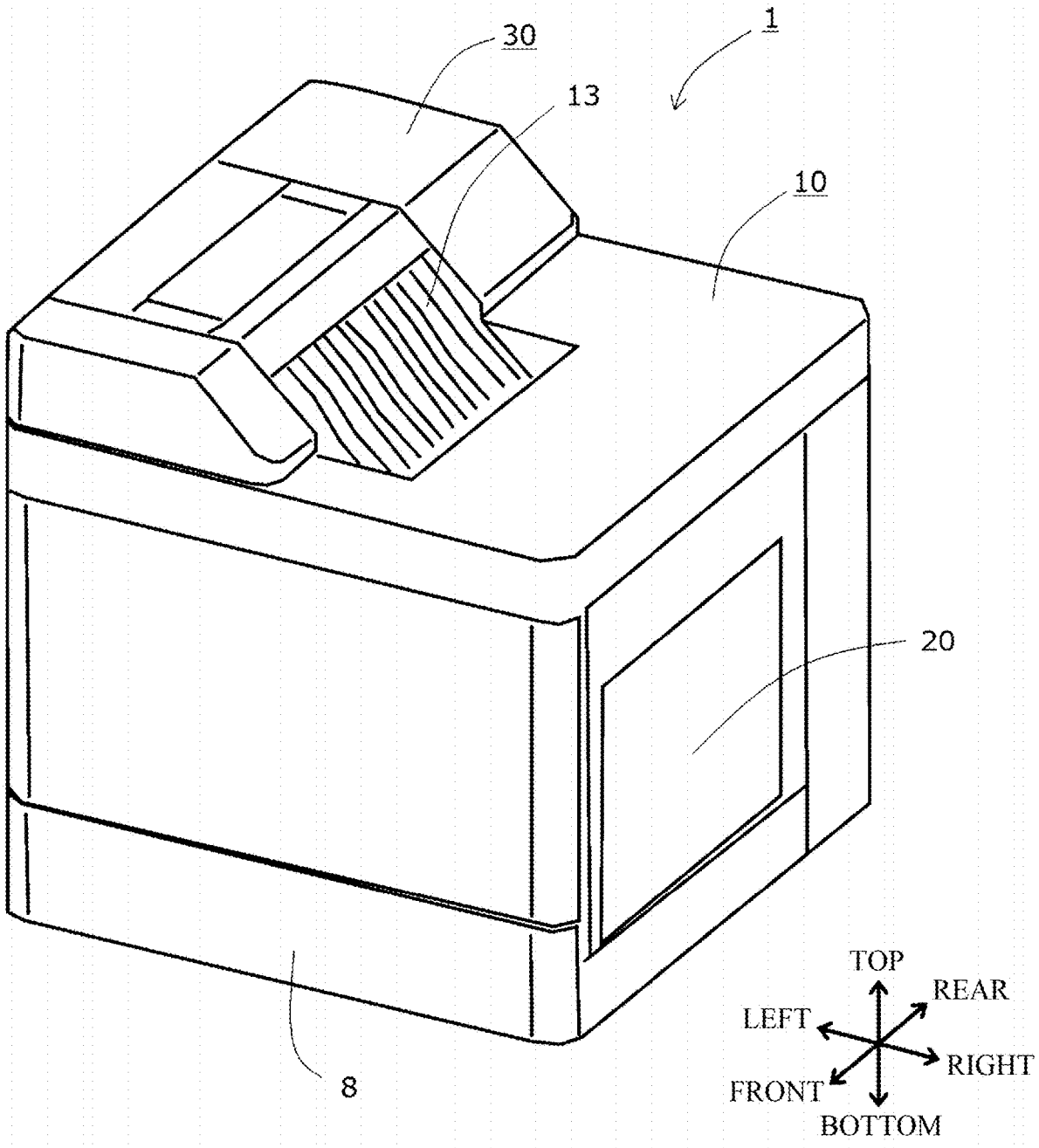
FIG. 5 is a perspective-view diagram illustrating the appearance of an image forming apparatus.

FIG. 5 is a perspective-view diagram illustrating the appearance of the image forming apparatus 1. The post-processing unit 30 is attached to the top of the apparatus body 10. The image forming apparatus 1 has a sheet cassette 8 at the bottom, an openable/closable tray 20 on the right side, and a first discharge tray 13 on the top face.

The internal configuration of the apparatus body 10 will be explained first. As illustrated in FIG. 1, the apparatus body 10 is provided with a sheet cassette 8 as a sheet accommodating portion for accommodating sheets P which are a recording medium, an image forming unit 1*e* as an image forming means, a first fixing unit 6 as a fixing means, and a housing 19 that accommodates the foregoing. The apparatus body 10 has a printing function of forming a toner image by the image forming unit 1*e* on the sheets P that are fed from the sheet cassette 8, and producing a printed product that is subjected to a fixing process by the first fixing unit 6.

The sheet cassette 8 is inserted into the housing 19 at the bottom of the apparatus body 10 so as to be withdrawable therefrom, and accommodates a large number of sheets P. The sheets P accommodated in the sheet cassette 8 are fed from the sheet cassette 8 by a feeding member such as a feeding roller, and are conveyed by the transport roller 8*a* in a state of having been separated one by one by a separating roller pair. Likewise, sheets set on an open tray 20 (FIG. 5) can be fed one by one.

The image forming unit 1*e* is a tandem-type electrophotographic unit provided with forming unit four process cartridges 7*n*, 7*y*, 7*m*, 7*c*, a scanner unit 2, and a transfer unit 3. The term process cartridge denotes a unit in which multiple components involved in the image forming process are integrally and replaceably configured into a unit.

The apparatus body 10 is provided with a cartridge support portion 9 supported by the housing 19, such that the process cartridges 7*n*, 7*y*, 7*m*, 7*c* are detachably mounted on respective mounting portions 9*n*, 9*y*, 9*m*, 9*c* provided in the cartridge support portion 9. The cartridge support portion 9 may be a tray member that can be withdrawn from the housing 19.

The process cartridges 7*n*, 7*y*, 7*m*, 7*c* have a substantially shared configuration, except for the type of powder contained in the four powder accommodating portions 104*n*, 104*y*, 104*m*, 104*c*. Specifically, each process cartridge 7*n*, 7*y*, 7*m*, 7*c* has a respective photosensitive drum 101 which is an image bearing member, a respective charging roller 102 which is a charging device, the powder accommodating portion 104*n*, 104*y*, 104*m*, 104*c* in which a respective powder is accommodated, and a respective developing roller 105 for developing, using that powder.

From among the four powder accommodating portions, the three powder accommodating portions 104*y*, 104*m*, 104*c* on the right side of the figure have accommodated therein printing toners Ty, Tm, Tc for yellow, magenta and cyan, as toners (first powder) for forming a visible image, on the sheets P. On the other hand, a powder adhesive Tn, which is a powder (second powder) for performing a bonding process after printing, is accommodated in the powder accommodating portion 104*n* on the leftmost side in the figure.

The powder accommodating portions 104*y*, 104*m*, 104*c* all are examples of first accommodating portion that accommodates a printing toner, while the powder accommodating portion 104*n* is an example of a second accommodating portion that accommodates a powder adhesive. The process cartridges 7*y*, 7*m*, 7*c* all are examples of a first process unit that forms a toner image using a printing toner, and the process cartridge 7*n* is an example of a second process unit that forms an image of a powder adhesive according to a predetermined application pattern.

In the case of printing of a black image such as text, the black image is rendered as process black which is a superposition of yellow (Ty), magenta (Tm) and cyan (Tc) toners. However, for instance a fifth process cartridge used for black printing toner may be added to the image forming unit 1*e*, so that black images can be rendered using black printing toner. The above configuration is non-limiting, and the type and number of printing toners can be modified depending on the intended application of the image forming apparatus 1.

The scanner unit 2 is disposed below the process cartridges 7*n*, 7*y*, 7*m*, 7*c* and above the sheet cassette 8. The scanner unit 2 is an exposure means for writing an electrostatic latent image on the photosensitive drum 101 of each process cartridge 7*n*, 7*y*, 7*m*, 7*c*, by irradiating each photosensitive drum 101 with laser light G.

The transfer unit 3 is provided with a transfer belt 3*a* as an intermediate transfer body (secondary image bearing member). The transfer belt 3*a* is a belt member wound around a secondary transfer inner roller 3*b* and a tension roller 3*c*, such that the outer periphery of the transfer belt 3*a* opposes the photosensitive drum 101 of each process cartridge 7*n*, 7*y*, 7*m*, 7*c*.

On the inner peripheral side of the transfer belt 3*a* there are arranged primary transfer rollers 4, at positions corresponding to respective photosensitive drums 101. A secondary transfer roller 5 as a transfer means is arranged at a position opposing the secondary transfer inner roller 3*b*. A transfer nip 5*n* between the secondary transfer roller 5 and the transfer belt 3*a* is a transfer section (secondary transfer section) at which the toner image is transferred from the transfer belt 3*a* to the sheets P.

The first fixing unit 6 is arranged above the secondary transfer roller 5. The first fixing unit 6 is a fixing unit of thermal fixing type, having a heat roller 6*a* as a fixing member and a pressure roller 6*b* as a pressing member. The heat roller 6*a* is heated by a heating element such as a halogen lamp, a ceramic heater or a heating mechanism of induction heating type. The pressure roller 6*b* is pressed against the heat roller 6*a* by an urging member such as a spring, and generates pressure for pressing the sheet P passing through the nip portion (fixing nip 6*n*) of the heat roller 6*a* and the pressure roller 6*b*.

The housing 19 is provided with a discharge port 12 (first discharge port) which is an opening for discharging the sheet P from the apparatus body 10; a discharge unit 34 is disposed in the discharge port 12. The discharge unit 34, which is a discharge means, uses a so-called triple roller having a first discharge roller 34*a*, an intermediate roller 34*b*, and a second discharge roller 34*c*.

A switching guide 33, which is a flap-shaped guide for switching the transport path of the sheet P, is provided between the first fixing unit 6 and the discharge unit 34. The switching guide 33 can swing about a shaft portion 33*a* so that a tip 33*b* reciprocates in the direction of arrow c in the figure.

The apparatus body 10 is provided with a mechanism for performing double-sided printing.

A motor, not shown, is connected to the discharge unit 34, such that the rotation direction of the intermediate roller 34*b* can be set to forward and reverse rotation. Further, a double-sided transport path 1*r* is provided as a transport path that is connected, in a loop fashion, to a main transport path 1*m*. Each sheet P, on a first surface of which an image becomes formed as the sheet passes along the main transport path 1*m*, is transported, while nipped between the first discharge roller 34*a* and the intermediate roller 34*b*, by the switching guide 33 having swung clockwise.

After the rear end of the sheet P in the traveling direction thereof has passed the switching guide 33, the switching guide 33 swings counterclockwise and the intermediate roller 34*b* reverses, whereupon the sheet P is reversely transported along the double-sided transport path 1*r*. An image becomes formed then on the second surface of the sheet P, as the sheet P passes once more along the main transport path 1*m*, but with the front and rear of the sheet P now flipped.

The sheet P after double-sided printing is transported, while nipped between the intermediate roller 34*b* and the second discharge roller 34*c*, by the switching guide 33 having swung counterclockwise, and is discharged from the apparatus body 10.

The transport path running along the transport roller 8*a*, the transfer nip 5*n*, and the fixing nip 6*n* in the apparatus body 10 constitutes the main transport path 1*m* in which an image is formed on the sheets P. As viewed from a main scanning direction at the time of image formation (width direction of the sheets perpendicular to the transport direction thereof, that are transported along the main transport path 1*m*), the main transport path 1*m* extends from the bottom to the top along one side of the image forming unit 1*e* in the horizontal direction.

In other words, the apparatus body 10 is a printer of so-called vertical transport type (vertical path type) in which the main transport path 1*m* extends in a substantially vertical direction. The first discharge tray 13, the intermediate path 15, and the sheet cassette 8 overlap each other, when viewed in the vertical direction. Therefore, the movement direction of the sheet P when discharged by the discharge unit 34 in the horizontal direction takes an opposite orientation to the to the movement direction of the sheet P when fed from the sheet cassette 8 in the horizontal direction.

Preferably, the horizontal-direction occupied range of the main body portion of the post-processing unit 30, excluding the second discharge tray 35, is encompassed within the occupied range of the apparatus body 10, from the point of view of FIG. 1 (when viewed in the main scanning direction at the time of image formation). By accommodating thus the post-processing unit 30 in the space above the apparatus body 10, the image forming apparatus 1 having a bonding/printing function can be installed in an installation space that is comparable to those of ordinary vertical path printers.

Bonding Unit

Figure 2:
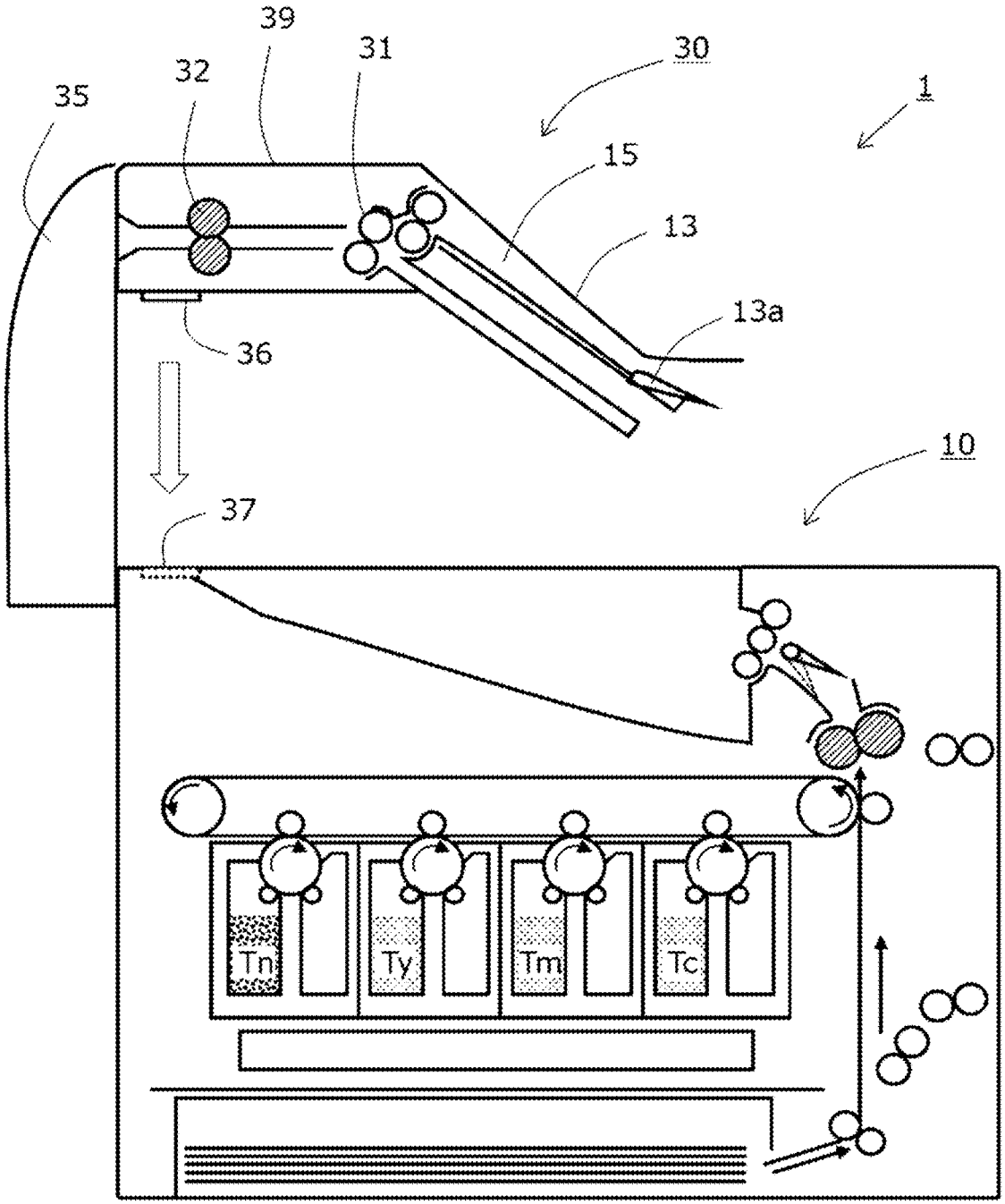
FIG. 2 is a diagram for explaining mounting of a bonding unit on the apparatus body of an image forming apparatus.

As illustrated in FIG. 2, the post-processing unit 30 is attached to top of the apparatus body 10. The post-processing unit 30 is a post-processing unit in which the folding device 31 as a folding means and the second fixing unit 32 as a bonding means (second fixing means) are integrally accommodated in a housing (second housing) 39.

Further, the post-processing unit 30 is provided with the first discharge tray 13 which rotatably holds the tray switching guide 13*a*, the intermediate path 15, and the second discharge tray 35. The first discharge tray 13 is provided on the top face of the post-processing unit 30, and is positioned on the top face (FIG. 1) of the entire image forming apparatus 1. The functions of each part of the post-processing unit 30 will be described below.

The post-processing unit 30 has a positioning portion (for instance a convex shape that engages with a depressed portion of the housing 19) for positioning a housing 39 with respect to the housing 19 (first housing) of the apparatus body 10. The post-processing unit 30 is provided with a drive source and a control unit separate from the apparatus body 10; herein a connector 36 of the post-processing unit 30 and a connector 37 of the apparatus body 10 are connected to thereby elicit electrical connection of the post-processing unit 30 with the apparatus body 10. As a result, the post-processing unit 30 is brought to a state of operating on the basis of commands from a control unit provided in the apparatus body 10, using power supplied via the apparatus body 10.

Process Cartridge

Figure 7:
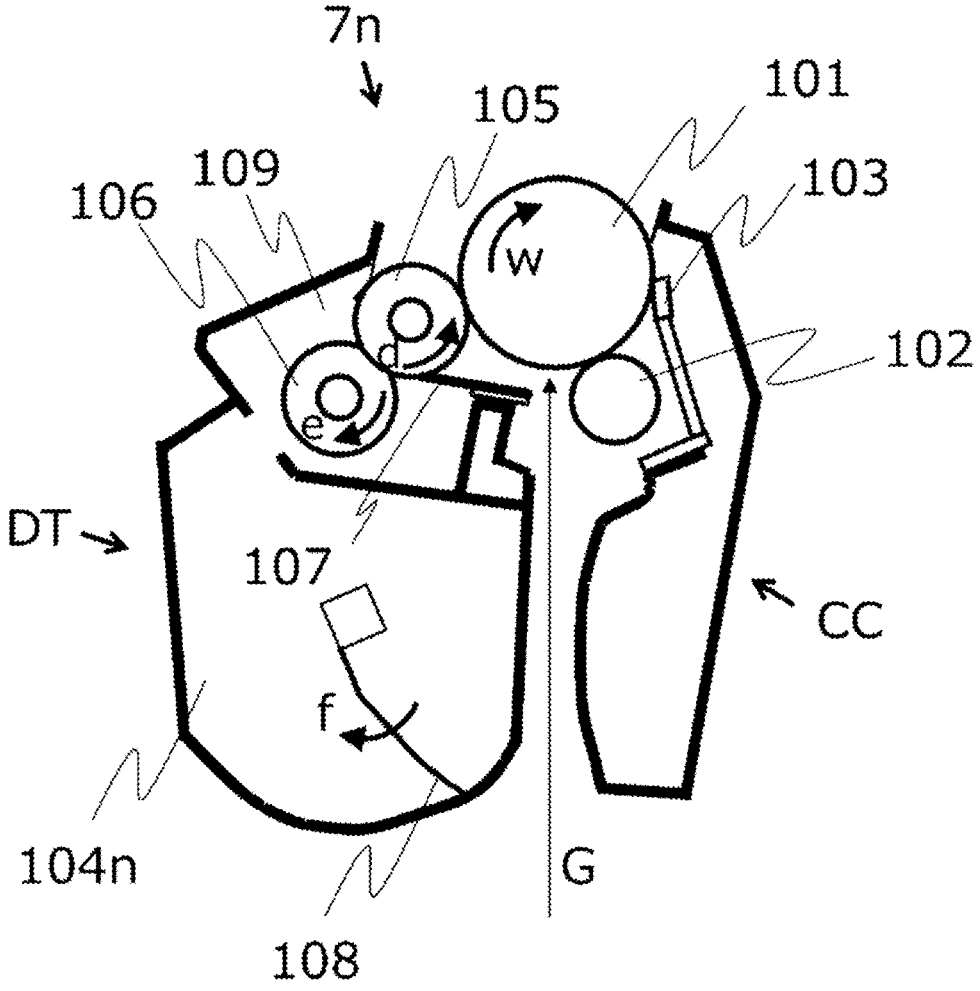
FIG. 7 is a schematic diagram of a process cartridge.

As described above, the process cartridges 7*n*, 7*y*, 7*m*, 7*c* have substantially a shared configuration, except for the types of powder contained in the four powder accommodating portions 104*n*, 104*y*, 104*m*, 104*c*. The process cartridge 7*n* will be explained here as a representative instance of the process cartridges. FIG. 7 is a schematic cross-sectional view of the process cartridge 7*n*. The process cartridge 7*n* is made up of a photosensitive member unit CC provided with the photosensitive drum 101 or the like, and a developing unit DT provided with the developing roller 105 or the like.

The photosensitive drum 101 is rotatably attached to the photosensitive member unit CC via a bearing not shown. Further, the photosensitive drum 101 is rotationally driven clockwise (arrow w) in the figure, in accordance with the image forming operation, by receiving the driving force of a drive motor as a driving means (drive source), not shown. The photosensitive member unit CC has further disposed therein a charging roller 102 for charging the photosensitive drum 101, and a cleaning member 103, around the photosensitive drum 101.

The developing unit DT is provided with a developing roller 105 as a developer carrier that comes into contact with the photosensitive drum 101 and rotates counterclockwise (arrow d) in the figure. The developing roller 105 and the photosensitive drum 101 rotate so that surfaces thereof at the portion (contact portion) where the surfaces oppose each other move in a same direction.

Further, the developing unit DT has disposed therein a developer supply roller 106 (hereafter simply referred to as a "supply roller") as a developer supply member that rotates clockwise (arrow e) in the figure. The supply roller 106 and the developing roller 105 rotate in such a manner that surfaces thereof at the portion (contact portion) where the surfaces oppose each other move in the same direction.

The supply roller 106 elicits the action of supplying the powder adhesive (printing toner in the case of the process cartridges 7*y*, 7*m*, 7*c*) onto the developing roller 105, and the action of stripping, off the developing roller 105, powder adhesive (printing toner in the case of the process cartridges 7*y*, 7*m*, 7*c*) remaining on the developing roller 105.

In the developing unit DT there is further disposed a developing blade 107 as a developer regulating member which regulates the layer thickness of the powder adhesive (printing toner in the case of the process cartridges 7*y*, 7*m*, 7*c*) that is supplied onto the developing roller 105 by the supply roller 106.

A powder adhesive (printing toner in the case of the process cartridges 7*y*, 7*m*, 7*c*) is accommodated, as a powder, in the powder accommodating portion 104*n*. A rotatably supported stirring member 108 is provided within the powder accommodating portion 104*n*. The stirring member 108 rotates clockwise (arrow f) in the figure to thereby stir the powder accommodated in the powder accommodating portion 104*n*, and convey the powder to the developing chamber 109 in which the developing roller 105 and the supply roller 106 are provided.

A configuration can also be adopted in which the photosensitive member unit CC and the developing unit DT are separate from each other and respectively constitute a photosensitive member unit cartridge and a developing unit cartridge that are attachable/detachable to/from the image forming apparatus body. Another configuration can be adopted that includes just the powder accommodating portion 104 and the stirring member 108, which make up a powder cartridge attachable/detachable to/from the apparatus body.

Image Forming Operation

Figure 3A:
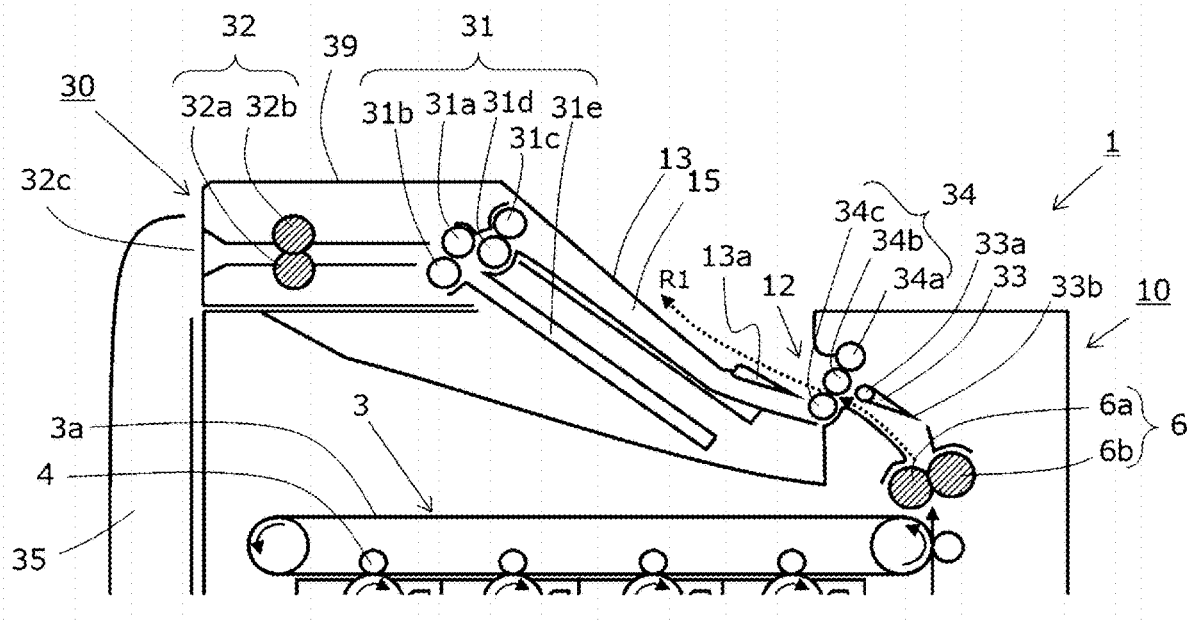
FIG. 3A and FIG. 3B are diagrams illustrating transport paths of sheets in an image forming apparatus.
Figure 3B:
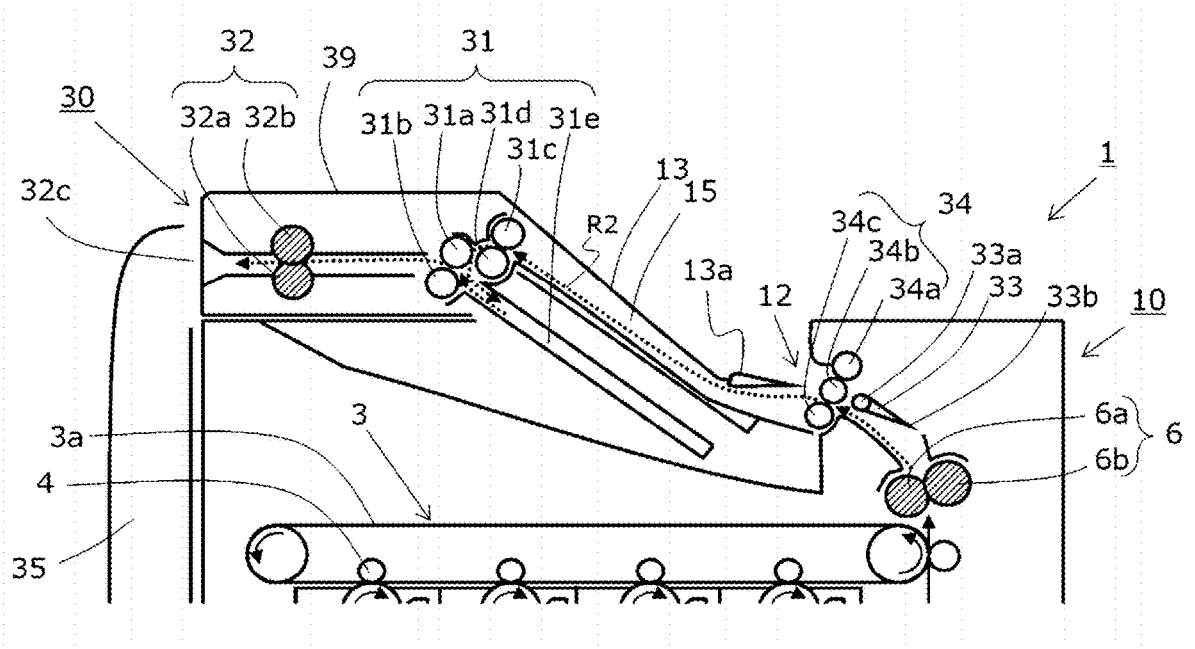
Figure 6A:
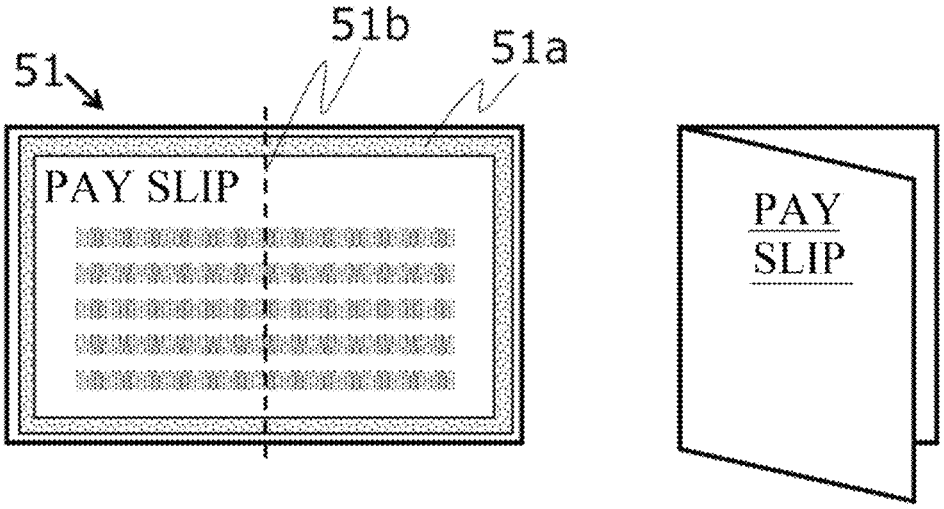
FIG. 6A and FIG. 6B are diagrams illustrating a deliverable outputted by an image forming apparatus.
Figure 6B:
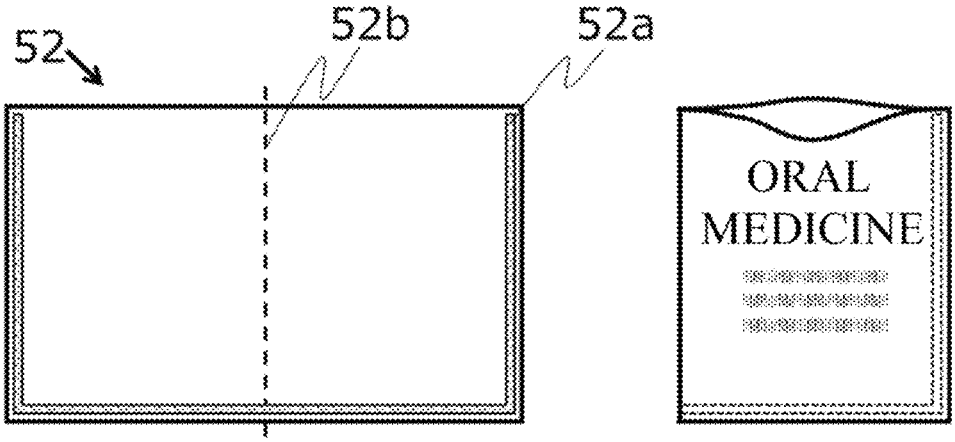

The image forming operation performed by the image forming apparatus 1 will be explained next with reference to FIG. 1 to FIG. 7. FIG. 3A and FIG. 3B are diagrams illustrating a sheet transport path in the image forming apparatus 1. FIG. 4A to FIG. 4F are diagrams for explaining the particulars of a folding process. FIG. 6A and FIG. 6B are diagrams illustrating a deliverable outputted by the image forming apparatus 1.

When data of an image to be printed and a print execution command are inputted to the image forming apparatus 1, the control unit of the image forming apparatus 1 conveys the sheets P and forms an image, and if necessary, initiates a series of operations (image forming operation) for execution of post-processing by the post-processing unit 30. In the image forming operation, firstly the sheets P are fed one by one from the sheet cassette 8, and are conveyed toward the transfer nip 5*n* via the transport roller 8*a*, as illustrated in FIG. 1.

In parallel with the feeding of each sheet P, the process cartridges 7*n*, 7*y*, 7*m*, 7*c* are sequentially driven and each photosensitive drum 101 is rotationally driven clockwise (arrow w) in the figure. The surface of the photosensitive drum 101 becomes uniformly charged at this time by the charging roller 102.

Further, the scanner unit 2 irradiates the photosensitive drum 101 of each process cartridge 7*n*, 7*y*, 7*m*, 7*c* with the laser beam G having been modulated on the basis of the image data, to thereby form a respective electrostatic latent image on the surface of each photosensitive drum 101. Next, the electrostatic latent image on each photosensitive drum 101 is developed as a powder image by the powder supported on the respective developing roller 105 of each process cartridge 7*n*, 7*y*, 7*m*, 7*c*.

The powder adhesive layer formed on each photosensitive drum 101 by being developed with the powder adhesive Tn differs from a toner image (ordinary toner image) of printing toner, for recording an image such as figures or text on the sheet P, in that the powder adhesive layer is not intended to convey visual information. In the explanation that follows, however, also a layer of powder adhesive Tn formed to a shape according to an application pattern as a result of an electrophotographic process, for the purpose of applying the powder adhesive Tn onto the sheet P according to a predetermined application pattern, is also treated as one instance of a "toner image".

The transfer belt 3*a* rotates counterclockwise (arrow v) in the figure. The toner images formed on the process cartridges 7*n*, 7*y*, 7*m*, 7*c* are primary-transferred from each photosensitive drum 101 to the transfer belt 3*a* on account of the electric field that is formed between the photosensitive drum 101 and the primary transfer roller 4.

The toner image supported on the transfer belt 3*a* and having reached the transfer nip 5*n* is secondary-transferred to a sheet P, having been transported along the main transport path 1*m*, by an electric field generated between the secondary transfer roller 5 and the secondary transfer inner roller 3*b*.

Thereafter, the sheet P is transported to the first fixing unit 6, and undergoes there a heat fixing process. Specifically, the printing toners Ty, Tm, Tc and the powder adhesive Tn melt, on account of heating and pressing of the toner image on the sheet P as the sheet P passes through the fixing nip 6*n*; thereafter, the printing toners Ty, Tm, Tc and powder adhesive Tn are fixed, and an image fixed to the sheet P is obtained as a result.

Irrespective of whether printing is single-sided or double-sided printing, the sheet P discharged from the apparatus body 10 is nipped between the intermediate roller 34*b* and the second discharge roller 34*c* as illustrated in FIG. 3A and FIG. 3B, and is transported by the tray switching guide 13*a* over a first route R1 or a second route R2.

The first route R1 illustrated in FIG. 3A is a route along which the sheet P that has passed through the first fixing unit 6 is discharged to the first discharge tray 13 by the discharge unit 34, in a normal printing mode in which the post-processing unit 30 is not used.

The second route R2 illustrated in FIG. 3B is a route in which the sheet P having passed through the first fixing unit 6 is discharged onto the second discharge tray 35 via the discharge unit 34, the folding device 31 and the second fixing unit 32 in a bonding/printing mode.

An intermediate path 15 is provided between the first fixing unit 6 and the folding device 31 in the second route R2. The intermediate path 15 is a sheet transport path that passes over the top face portion (top surface portion) of the image forming apparatus 1, and extends substantially parallel to the first discharge tray 13 under the first discharge tray 13. The intermediate path 15 and the first discharge tray 13 are tilted upward in the vertical direction, towards the folding device 31, relative to the horizontal direction. Therefore, an inlet of the folding device 31 (hereafter guide roller pair (31*c*, 31*d*)) is positioned higher up, in the vertical direction, than an outlet of the apparatus body 10 (nip of the intermediate roller 34*b* and the second discharge roller 34*c*).

The folding device 31 has four rollers, namely a first guide roller 31*c*, a second guide roller 31*d*, a first folding roller 31*a* and a second folding roller 31*b*, as well as a draw-in portion 31*e*. The first guide roller 31*c* and the second guide roller 31*d* are a guide roller pair that nips and conveys each sheet P received from a transport path (intermediate path 15 in the present embodiment) on the upstream side of the folding device 31. The first folding roller 31*a* and the second folding roller 31*b* are a folding roller pair that feeds out the sheet P while folding the sheet P.

A spacing M (FIG. 1) from the second discharge roller 34*c* up to the first guide roller 31*c* in the sheet transport direction along the second route R2 is shorter than a total length L (FIG. 4A) of the sheet P, in the transport direction, prior to the folding process. In other words, the spacing M from the second discharge roller 34*c* up to the first guide roller 31*c* determines the lower limit of the length, in the transport direction, of the sheets that can be processed by the post-processing unit 30. Thanks to this configuration the sheet P is delivered from the discharge unit 34 to the guide roller pair without delay.

The folding process by the folding device 31 will be explained with reference to FIG. 4A to FIG. 4F. When the folding process is executed, the first guide roller 31*c* and the first folding roller 31*a* rotate clockwise in the figure, and the second guide roller 31*d* and the second folding roller 31*b* rotate counterclockwise in the figure.

Figure 4A:
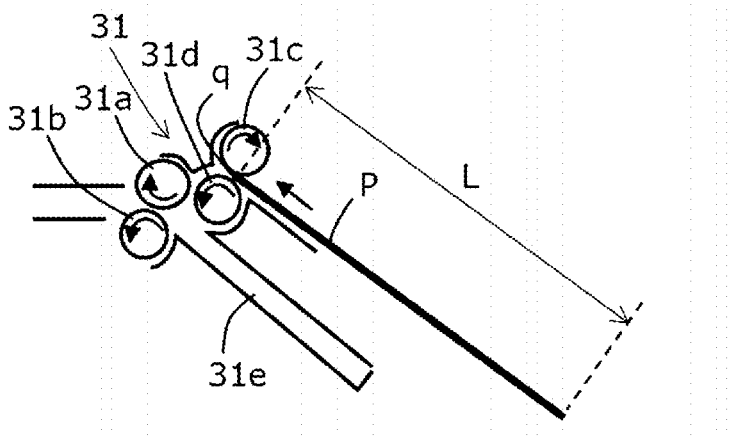
FIG. 4A to FIG. 4F are diagrams for explaining the particulars of a folding process.
Figure 4B:
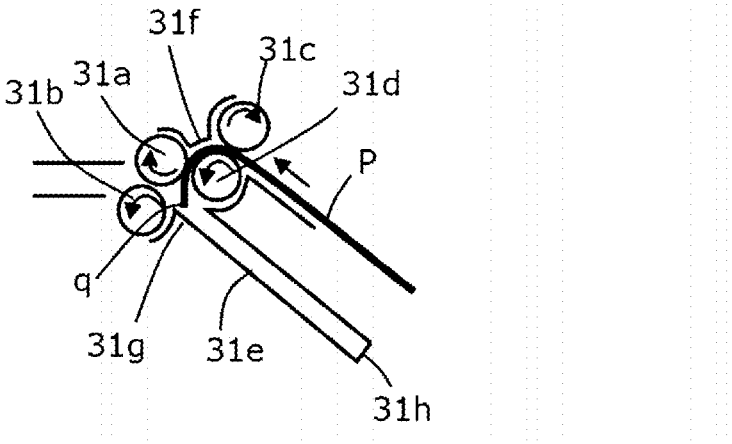

As illustrated in FIG. 4A, first a tip q of each sheet P fed out from the discharge unit 34 is drawn into the guide roller pair (31*c*, 31*d*). As illustrated in FIG. 4B, the tip q of the sheet P is guided downward by a guide wall 31*f*, and comes into contact with the first folding roller 31*a*; thereupon, the tip q is pulled in between the first folding roller 31*a* and second guide roller 31*d* that oppose each other, and hits a wall 31*g* of the draw-in portion 31*e*.

Figure 4C:
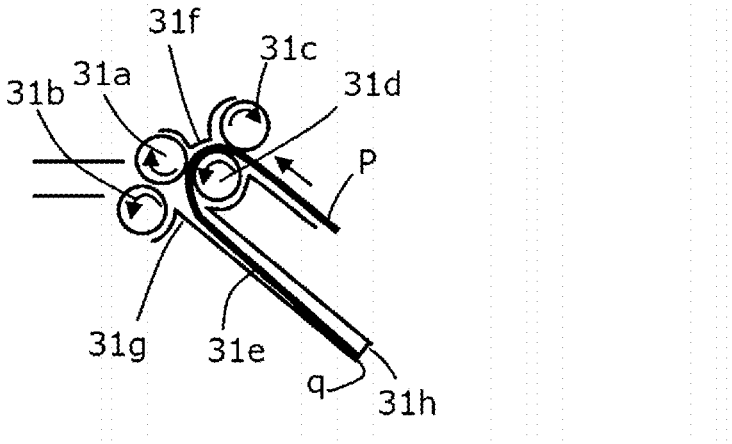

As the sheet P is pulled in by the guide roller pair (31*c*, 31*d*), the tip q advances to the far side of the draw-in portion 31*e* while sliding over the wall 31*g*. The tip q abuts eventually an end portion 31*h* of the draw-in portion 31*e*, as illustrated in FIG. 4C. The draw-in portion 31*e* forms a space extending substantially parallel to the intermediate path 15 under the intermediate path 15, such that the sheet P becomes bent to a U-shape by being wound around the second guide roller 31*d*, at the stage in FIG. 4C.

Figure 4D:
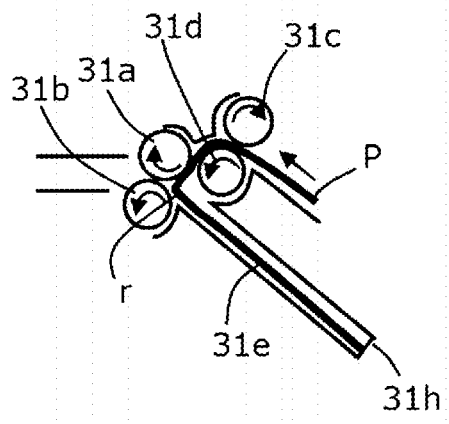
Figure 4E:
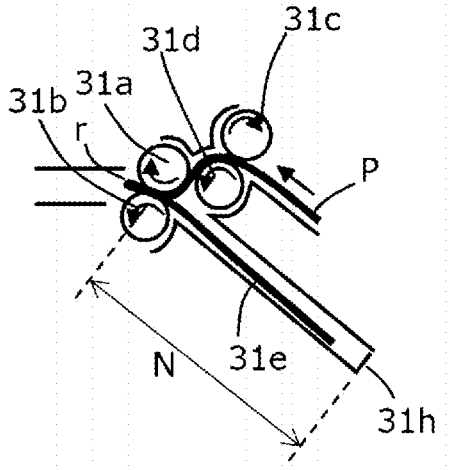
Figure 4F:
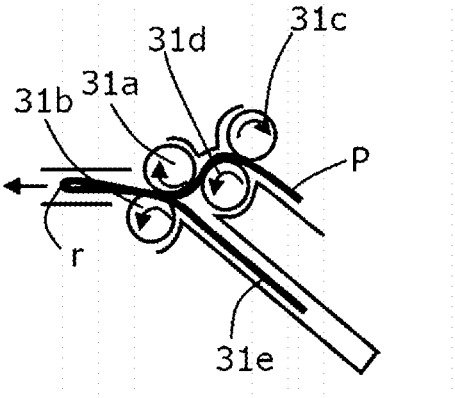

When the sheet P is then further drawn in by the guide roller pair (31*c*, 31*d*) from the state of FIG. 4C, the sheet begins to deflect in a middle portion r, as illustrated in FIG. 4D. As illustrated in FIG. 4E, the middle portion r comes eventually in contact with the second folding roller 31*b*, as a result of which the middle portion r is drawn into the nip portion of the folding roller pair (31*a*, 31*b*) on account of the frictional force received from the second folding roller 31*b*. The sheet P is then discharged by the folding roller pair (31*a*, 31*b*) as illustrated in FIG. 4F, with the middle portion r at the forefront, in a state where the sheet P has been folded along the middle portion r as a folding crease.

A depth N of the draw-in portion 31*e* (FIG. 4E), i.e. the distance from the nip portion of the folding roller pair (31*a*, 31*b*) to the end portion 31*h* of the draw-in portion 31*e* is set to be half of the total length L of the sheet P. As a result, the folding device 31 can execute a process (middle folding) of folding the sheet P over half the length of the sheet. The position of the folding crease can be modified arbitrarily by modifying the depth N of the draw-in portion 31*e*.

The folding device 31 explained above is an example of a folding means; herein there may be used a folding mechanism that forms a folding crease by pressing a blade against the sheet P, to push the sheet P it into the nip portion of the roller pair. The folding process is not limited to folding in half, and for instance a folding mechanism that produces Z-folds or tri-folds may also be used.

The folding device 31 is made up of the rotating rollers and the fixed draw-in portion 31*e*, and accordingly the drive mechanism of the folding device 31 can be simplified as compared with a folding mechanism that utilizes a reciprocating blade. Further, the folding device 31 may be provided, in addition to the four rollers, also with the draw-in portion 31*e* having a depth N of half the sheet length, thanks to which the size of the post-processing unit 30 can be reduced.

The sheet P having passed through the folding device 31 is conveyed to the second fixing unit 32, as illustrated in FIG. 3B. The second fixing unit 32 has a configuration relying on a heat fixing scheme, similarly to the first fixing unit 6. That is, the second fixing unit 32 has a heat roller 32*b* as a heating member and a pressure roller 32*a* as a pressing member. The heat roller 32*b* is heated by a heating element such as a halogen lamp or a ceramic heater, or by a heating mechanism of induction heating type.

The pressure roller 32*a* is pressed against the heat roller 32*b* by an urging member such as a spring, and, together the heat roller 32*b*, generates pressure for pressing the sheet P having passed through the nip portion of the pressure roller 32*a* (bonding nip).

The sheet P folded by the folding device 31 is bonded, in a folded state, by undergoing a bonding process by the second fixing unit 32 (by being heat-fixed a second time to the image surface on which the powder adhesive Tn is applied). That is, when the sheet P passes through the bonding nip the powder adhesive Tn on the sheet P is heated and pressed in a re-melted state, as a result of which the sheet P becomes adhered to the facing surface (the surface of the powder adhesive Tn opposing the image surface of the sheet P having the toner image transferred thereonto, with the sheet P in a folded state). The powder adhesive Tn cools then down and solidifies, as a result of which the facing surface and the image surface of the sheet P become connected (bonded) using the powder adhesive Tn as an adhesive.

As illustrated in FIG. 3B, the sheet P that has undergone the bonding process by the second fixing unit 32 is discharged on the left of the figure from the discharge port 32*c* (second discharge port) provided in the housing 39 of the post-processing unit 30. The sheet P is then accommodated in the second discharge tray 35 (see FIG. 1) provided on the left side of the apparatus body 10. This completes the image forming operation for a case where the sheet P is conveyed along the second route R2.

The bonding location of the folded sheet P can be modified on the basis of the application pattern of the powder adhesive Tn on the sheet P. FIG. 6A and FIG. 6B illustrate deliverables (outputs products of an image forming apparatus) having different application patterns of the powder adhesive Tn.

FIG. 6A is an example of a deliverable (half-bonded product) for uses in which the product is opened by a recipient. In the case of the pay slip 51 of FIG. 6A, the powder adhesive Tn is applied onto the entire circumference 51*a* of the outer peripheral portion of one face of the sheet P, with bonding in a state where the sheet P is folded along the folding crease 51*b* at the center.

FIG. 6B illustrates a bag (medicine bag) as an example of a deliverable (fully bonded deliverable) for an application in which the deliverable is not meant to be opened. In this case, the powder adhesive Tn is applied onto a C-shaped region 52*a* so that three sides of the folded sheet P, encompassing the folding crease 52*b*, are joined together. In FIG. 6B no image is formed on the inward side of the bag, although an image can be formed if necessary.

The image forming apparatus 1 can output any of the deliverable products illustrated in FIG. 6A and FIG. 6B in a one-stop manner, without preparation of pre-print paper. That is, the powder adhesive Tn is applied in a predetermined application pattern, in parallel with the operation of recording an image on one or both faces of the sheet P using printing toner, with an ensuing folding process and bonding process to yield a deliverable that can be outputted in that state.

In the case for instance of output of the deliverables of FIG. 6A and FIG. 6B, one side of the sheet P used as base paper lies on the outside of the deliverable, and the other side lies on the inside of the deliverable. As an image forming operation of the first surface in double-sided printing, an image for the outer surface may be formed using the printing toner; as an image forming operation of the second surface, an image for the inner surface may be formed using the printing toner, and the powder adhesive Tn may be applied according to a predetermined application pattern.

The image recorded by the image forming apparatus 1 using the printing toner can include a format (invariable portion) in a case where pre-printed paper is used, and a variable portion such as personal information. Therefore, it is possible to output a deliverable that is bonded as a result of a bonding process, from base paper such as blank paper not being pre-print paper, as described above. However, the image forming apparatus 1 can be used in applications in which there are performed a bonding process and printing process of a variable portion, using pre-print paper as the recording medium.

Method for Producing a Bonded Product (Deliverable)

The method for producing a bonded product is a method for producing a bonded product resulting from bonding at least one sheet of paper, via an adhesive portion by using the above electrophotographic developer set, the bonded product has a surface A on which an adhesive portion of the powder adhesive is fixed, and a surface B on which a toner image portion of the toner is fixed, the surface B being a surface different from the surface A, wherein the method comprises the following steps, in no particular order:

forming the toner image portion on the surface B, and fixing the toner image portion on the surface B by heating; and forming the adhesive portion on the surface A, and fixing the adhesive portion on the surface A by heating, and wherein the method further comprises the following steps, after formation and fixation of the toner image portion and the adhesive portion, overlaying the paper so as to sandwich the adhesive portion, and melting the adhesive portion thereby bonding the paper to obtain the bonded product.

The bonded product may be of a form in which one sheet of paper is folded and bonded via the adhesive portion, or of a form in which two sheets of paper are bonded via the adhesive portion. The bonded product has for instance a bag-like or tubular form.

In a case where the paper is bonded via the adhesive portion, the surface A on which the adhesive portion is present may in turn be present on the two faces of the bonded product, while the adhesive portion derived from the powder adhesive may be formed on at least one of the two faces.

In a case where the paper is bonded via the adhesive portion, the surface B, which is a surface different from the surface A on which the adhesive portion is present, may similarly be in turn present on two faces in the bonded product, while the toner image portion may be formed on at least one of the two faces. Also, it suffices that the toner image portion be formed on at least the surface B, while the toner image portion may or may not be formed on the surface A.

The order of the toner image portion formation step and the adhesive portion formation step is not limited. Either step may be carried out first, or both steps may be carried out at the same time. Forming and fixing of the toner image portion and forming and fixing of the adhesive portion can be performed for instance using the above-described image forming apparatus. A known electrophotographic method can also be resorted to. In a case where two sheets of paper are bonded together, the toner image portion and the adhesive portion may be formed on one of the paper sheets or on both paper sheets.

In the case of one sheet of paper, the adhesive portion may be formed on one side of the paper, and the toner image portion may be formed at least on the other side.

After formation of the toner image portion and the adhesive portion, one paper sheet is folded and the adhesive portion is tucked in, in the case of a single sheet of paper; alternatively, two paper sheets are overlaid and the adhesive portion is tucked in, in the case of two sheets of paper. The paper is then bonded through melting of the adhesive portion by heating, to obtain the bonded product (deliverable). Such a bonding step can be performed using for instance above-described image forming apparatus and sheet processing device.

Methods for measuring various physical properties will be described next.

Method for Measuring the Storage Elastic Modulus of the Toner and Powder Adhesive Measurement is performed using a dynamic viscoelasticity measuring device (rheometer) ARES (by Rheometrics Scientific Ltd.). A toner or powder adhesive is used as the respective sample.

The measuring jig: serrated parallel plates having a diameter of 7.9 mm are used herein.

Measurement sample: a cylindrical sample having a diameter of 8 mm and a height of 2 mm is molded out of a 0.1 g sample using a pressure molding machine, (maintaining 15 kN at normal temperature for 1 minute). Herein a 100 kN press NT-100H by NPa System Co., Ltd. is used as the pressure molding machine.

The temperature of the serrated parallel plates is adjusted to 120° C., the cylindrical sample is heated and melted, serrations are caused to bite, and a vertical load is applied so that the axial force does not exceed 30 (gf) (0.294 N), to fix the sample to the serrated parallel plates. At this time a steel belt may be used such that the diameter of the sample becomes identical to the diameter of the parallel plates. The serrated parallel plates and the cylindrical sample are slowly cooled for 1 hour down to a measurement start temperature of 30.00° C.

Measurement frequency: 6.28 radians/s

Measurement strain setting: initial value set to 0.1%, with measurement performed in the automatic measurement mode Sample elongation correction: adjusted in the automatic measurement mode Measurement temperature: temperature raised from 30° C. up to 180° C. at a rate of 2° C. per minute Measurement interval: viscoelasticity data measured every 30 seconds, i.e. every 1° C.

The Gb'(100) of the powder adhesive and the Gt'(100) of the toner are obtained from the curves of storage elastic modulus obtained as a result of this measurement.

Method for Identifying the Molecular Structure of Thermoplastic Resins and Waxes, the Content N of the Wax A in the Powder Adhesive, the Content Na of Total Wax in the Toner, and the Content Nb of Total Wax in the Powder Adhesive A pyrolysis-gas chromatography mass spectrometer (hereafter pyrolysis-GC/MS) and NMR are used for identification of the molecular structure of the thermoplastic resins and waxes, and for measurement of the content N of the wax A in the powder adhesive, the content Na of total wax in the toner, and the content Nb of total wax in the powder adhesive.

Pyrolysis-GC/MS allows determining the monomers that make up the totality of resin in a sample, and working out the peak area of each monomer; to quantify the monomers, it is however necessary to standardize peak intensity by a sample of known concentration as a reference. By contrast, NMR allows identifying and quantifying constituent monomers without using a sample of known concentration.

Therefore, constituent monomers are determined by comparing the spectra of both NMR and pyrolysis-GC/MS, depending on the situation.

Specifically, monomers are quantified by NMR measurement in a case where the amount of a resin component insoluble in deuterated chloroform, which is the extraction solvent in an NMR measurement, is less than 5.0 mass %.

In a case by contrast where there is present 5.0 mass % or more of a resin component insoluble in deuterated chloroform being an extraction solvent in an NMR measurement, the deuterated chloroform-soluble fraction is measured both by NMR and pyrolysis-GC/MS, and the deuterated chloroform-insoluble fraction is measured by pyrolysis-GC/MS.

In this case firstly the deuterated chloroform-soluble fraction is subjected to NMR measurement, to determine and quantify the constituent monomers (Quantitative result 1). Next, a pyrolysis-GC/MS measurement is performed on the deuterated chloroform-soluble fraction, to work out the peak area of respective peaks attributable to each constituent monomer. Then Quantitative result 1 obtained in the NMR measurement is used for working out the relationship between the amount of each constituent monomer and peak area in pyrolysis-GC/MS.

Next, a pyrolysis-GC/MS measurement of the deuterated chloroform-insoluble fraction is performed, to work out the peak area of respective peaks attributable to each constituent monomer. The constituent monomers in the deuterated chloroform-insoluble fraction are then quantified (Quantitative result 2) on the basis of the relationship between the amount of respective constituent monomers and peak area in pyrolysis-GC/MS, as obtained in the measurement of the deuterated chloroform-soluble fraction.

Then Quantitative result 1 and Quantitative result 2 are combined, to yield a final quantitative result of each constituent monomer. The following operations are specifically carried out.

(1) Herein 50 mg of toner or powder adhesive is weighed exactly in an 8 mL glass sample bottle, 1 mL of deuterated chloroform is added and the lid is closed, after which the resulting mixture is dispersed and dissolved for 1 hour using an ultrasonic disperser. The mixture is filtered using a membrane filter having a diameter of 0.4 μm, and the filtrate is recovered. The deuterated chloroform-insoluble fraction remains at that time on the membrane filter.

(2) Then a $^{1}$H-NMR measurement is performed on the filtrate, and the resulting spectrum is attributed to the constituent monomers of the resin, to work out quantitative values.

(3) If the deuterated chloroform-insoluble fraction needs to be analyzed, this is done by pyrolysis-GC/MS. A derivatization treatment such as methylation is performed as needed.

NMR Measurement Conditions

Bruker AVANCE 500, by Bruker Biospin Corporation

Measured nucleus: $^{1}$H

Measurement frequency: 500.1 MHz

Number of scans: 16 scans

Measurement temperature: room temperature

Pyrolysis GC/MS Measurement Conditions

Pyrolysis apparatus: TPS-700 by Japan Analytical Industry Co., Ltd.

Pyrolysis temperature: appropriate value from 400° C. to 600° C.

GC/MS apparatus: ISQ by Thermo Fisher Scientific Inc.

Column: "HP5-MS" (Agilent/190915-433), length 30 m, internal diameter 0.25 mm, film thickness 0.25 μm GC/MS Conditions Inlet conditions:

InletTemp: 250° C.

SplitFlow: 50 mL/min

GC temperature rise conditions: 40° C. (5 min)→10° C./min (300° C.)→300° C. (20 min)

Method for Calculating Ester Group Concentration in a Thermoplastic Resin

An ester group concentration Ec of a thermoplastic resin is calculated herein on the basis of the molecular structures and mass ratios of the constituent monomers of the thermoplastic resin, as obtained in the above measurements.

The ester group concentration Ec of the thermoplastic resin is given by $$Ec=1000\times ac/nc \text{ (mmol/g)}$$

where nc (g/mol) denotes the molecular weight of the monomer from which there derives the structure that makes up the thermoplastic resin, and ac (mol) denotes the number of ester groups contained in one molecule of the monomer.

In a case where the resin is made up of a structure derived from a plurality of monomers, the ester group concentration is worked out in the same way for each monomer.

The ester group concentration of the thermoplastic resin is then calculated on the basis of the ester group concentration of each monomer thus worked out and the respective content (mass %) of the structure derived from the monomers, in the thermoplastic resin, by multiplying contents by respective coefficients set out below.

For instance, the ester group concentration Ec of the thermoplastic resin made up of a structure derived from three types of monomer, namely monomer 1, monomer 2 and monomer 3, is worked out on the basis of the expression below, where Ec1 denotes the ester group concentration of monomer 1, Nc1 denotes the constituent ratio (mass % in the thermoplastic resin) of monomer 1, Ec2 denotes the ester group concentration of monomer 2, Nc2 denotes the constituent ratio of monomer 2, Ec3 denotes the ester group concentration of monomer 3, and Nc3 denotes the constituent ratio of monomer 3.

$$Ec=Ec1\times(Nc1/(Nc1+Nc2+Nc3))+Ec2\times(Nc2/(Nc1+Nc2+Nc3))+Ec3\times(Nc3/(Nc1+Nc2+Nc3))$$

The number of monomers that may be used simultaneously is not limited.

In a case where the thermoplastic resin contains a plurality of resins, the ester group concentration of the thermoplastic resin is calculated as an average value obtained by multiplying respective contents (mass %) by a coefficient.

Method for Measuring Glass Transition Temperature (Tg)

The glass transition temperature (Tg) is measured using a differential scanning calorimeter "Q1000" (by TA Instruments Inc.). The melting points of indium and zinc are used for temperature correction in the detection unit of the device, and the heat of fusion of indium is used for correcting the amount of heat.

Specifically, 1 mg of a sample is weighed exactly and is placed on a pan made of aluminum; the empty aluminum pan is used herein as a reference. Using a modulation measurement mode, a measurement is then performed over a range from 0° C. to 100° C. at a ramp rate of 1° C./min and temperature modulation conditions of ±0.6° C./60 seconds. Since a change in specific heat is obtained in the process of raising the temperature, the glass transition temperature (Tg) is taken herein as the intersection of a differential thermal curve and a middle line between baselines before and after the onset of the change in specific heat.

Method for Measuring Weight-Average Particle Diameter (D4)

The weight-average particle diameter (D4) is calculated as follows.

A precision particle size distribution measuring apparatus based on a pore electrical resistance method and provided with a 100 μm aperture tube "Coulter Counter Multisizer 3" (registered trademark, by Beckman Coulter, Inc.), is used as the measuring apparatus. Dedicated software "Beckman Coulter Multisizer 3 Version 3.51" (by Beckman Coulter, Inc.) ancillary to the apparatus is used for setting measurement conditions and analyzing measurement data. The measurement is performed with 25000 effective measurement channels.

An electrolyte aqueous solution prepared by dissolving reagent-grade sodium chloride in ion-exchanged water to a concentration of 1.0%, for instance "ISOTON II" (by Beckman Coulter, Inc.), can be used in the measurement.

The dedicated software is set as described below prior to measurement and analysis.

In the "Change standard measurement method (SOMME)" screen of the dedicated software, the total count number of a control mode is set to 50000 particles, the number of measurements is set to 1, and a value obtained by using "Standard particles of 10.0 μm" (by Beckman Coulter, Inc.) is set as a Kd value. A threshold and a noise level are automatically set by pressing a "Threshold/noise level measurement button". In addition, current is set to 1600 μA, gain is set to 2, the electrolyte solution is set to ISOTON II, and the check box "Flushing after measurement" is ticked.

In the "Setting for conversion from pulse to particle diameter" screen of the dedicated software, a bin interval is set to a logarithmic particle diameter, the number of particle diameter bins is set to 256, and a particle diameter range is set to a range from 2 μm to 60 μm.

The concrete measurement method is as follows.

(1) About 200.0 mL of the electrolyte aqueous solution is placed in a 250-mL round-bottom beaker made of glass dedicated for Multisizer 3; the beaker is set in a sample stand, and the electrolyte aqueous solution in the beaker is stirred with a stirrer rod at 24 revolutions/s counterclockwise. Dirt and bubbles in the aperture tube are removed by the "Aperture flush" function of the dedicated software.

(2) About 30.0 mL of the electrolyte aqueous solution is charged into a 100-mL flat-bottom beaker made of glass. About 0.3 mL of a diluted solution obtained by diluting "Contaminon N" (10% aqueous solution of a neutral detergent for washing precision measuring instruments and made up of a nonionic surfactant, an anionic surfactant and an organic builder and having a pH of 7, by Wako Pure Chemical Industries, Ltd.) thrice by mass in ion-exchanged water is added as a dispersing agent to the electrolyte aqueous solution.

(3) An ultrasonic disperser "Ultrasonic Dispersion System Tetora 150" (by Nikkaki Bios Co., Ltd.) in which two oscillators each having an oscillatory frequency of 50 kHz are built so as to be out of phase by 180 degrees and which has an electrical output of 120 W is prepared herein. Then 3.3 L of ion-exchanged water is charged into the water tank of the ultrasonic disperser, and about 2.0 mL of Contaminon N are added to the water tank.

(4) The beaker in (2) is set in a beaker-securing hole of the ultrasonic disperser, which is then operated. The height position of the beaker is adjusted so as to maximize a resonance state at the liquid surface of the aqueous electrolyte solution in the beaker.

(5) With the aqueous electrolyte solution in the beaker of (4) being thus ultrasonically irradiated, about 10 mg of the toner are then added little by little to the aqueous electrolyte solution, to be dispersed therein. The ultrasonic dispersion treatment is further continued for 60 seconds. The water temperature of the water tank during ultrasonic dispersion is adjusted as appropriate to lie in the range from 10° C. to 40° C.

(6) The aqueous electrolyte solution in (5) containing the dispersed toner is added dropwise, using a pipette, to the round-bottomed beaker of (1) set inside the sample stand, to adjust the measurement concentration to about 5%. A measurement is then performed until the number of measured particles reaches 50000.

(7) Measurement data is analyzed using the dedicated software ancillary to the apparatus, to calculate the weight-average particle diameter (D4). The "Average size" in the "Analysis/volume statistics (arithmetic mean)" screen, when Graph/vol % is selected in the dedicated software, yields herein the weight-average particle diameter (D4).

Method for Measuring a Molecular Weight Distribution and Peak Molecular Weights

A molecular weight distribution and peak molecular weights are measured by gel permeation chromatography (GPC), as follows.

Firstly the measurement sample is dissolved in tetrahydrofuran (THF). The obtained solution is then filtered through a solvent-resistant membrane filter "MYSYORI DISC" (by Tosoh Corporation) having a pore diameter of 0.2 μm, to obtain a sample solution. The sample solution is adjusted so that the concentration of the THF-soluble fraction is 0.8 mass %. A measurement is performed then under the conditions below, using the sample solution.

Device: high-speed GPC device "HLC-8220 GPC" (by Tosoh Corporation)
Column: two columns LF-604 (by Showa Denko KK)
Eluent: THF
Flow rate: 0.6 mL/min
Oven temperature: 40° C.
Sample injection volume: 0.020 mL To calculate the molecular weight of the sample there is used a molecular weight calibration curve created using a standard polystyrene resin (product name "TSK STANDARD POLYSTYRENE F-850, F-450, F-288, F-128, F-80, F-40, F-20, F-10, F-4, F-2, F-1, A-5000, A-2500, A-1000 or A-500", by Tosoh Corporation). The largest peak in the obtained molecular weight distribution is set as the main peak, and the value of the molecular weight of that peak is taken as the peak molecular weight.

Isolation of a Thermoplastic Resin From the Toner or Powder Adhesive

Various physical properties can also be measured by using a thermoplastic resin isolated from the toner or powder adhesive in accordance with the following method.

The toner or powder adhesive is dispersed in ethanol, which is a poor solvent for the toner or powder adhesive, and the temperature is raised to beyond the melting point of the thermoplastic resin. Pressing may be performed at this time as needed. The thermoplastic resin having exceeded the melting point melts at this point in time. Thereafter, the thermoplastic resin can be retrieved from the toner or powder adhesive by solid-liquid separation. In a case where the separated material is a mixture, the thermoplastic resin can be isolated by classifying the mixture for each molecular weight. The thermoplastic resin can also be identified on the basis of the molecular structure of the material in accordance with the above-described methods.

EXAMPLES

The present disclosure will be specifically explained hereafter by means of examples, but the present disclosure is not meant to be limited to or by these examples. In the examples, the language "parts" refers to parts by mass in all instances.

Table 1 sets out the composition and physical properties of the waxes used in examples and comparative examples.

TABLE 1

| | Composition | Tm (° C.) | Molecular weight | Ester group concentration (mmol/g) |
|---|---|---|---|---|
| Wax 1 | Ethylene glycol distearate | 76 | 595 | 3.37 |
| Wax 2 | Glyceryl tristearate | 70 | 891 | 3.37 |
| Wax 3 | Pentaerythritol tetrapalmitate | 63 | 1090 | 3.67 |
| Wax 4 | Dibehenyl sebacate | 73 | 818 | 2.44 |
| Wax 5 | Ethylene glycol dibehenate | 83 | 706 | 2.83 |
| Wax 6 | HNP-9 | 78 | 490 | 0.00 |
| Wax 7 | Behenyl behenate | 73 | 649 | 1.54 |

In the table, HNP-9 is a linear saturated hydrocarbon wax produced by Nippon Seiro (having a peak carbon number of 33) and Tm denotes the melting point.

Production Example of Polyester Resin 1

Into a reaction vessel equipped with a stirrer, a thermometer, a nitrogen introduction tube, a dewatering tube and a pressure-reducing device there were added 1.00 mol of terephthalic acid, 0.65 mol of a propylene oxide 2-mole adduct of bisphenol A, and 0.35 mol of ethylene glycol, in molar ratio, as monomers, with heating up to a temperature of 130° C. while under stirring, to yield a monomer mixture.

Thereafter, 0.52 parts of tin(II) 2-ethylhexanoate as an esterification catalyst were added to 100.00 parts of the above monomer mixture, the temperature was raised to 200° C., and condensation polymerization was carried out up to a desired molecular weight.

Further, 3.00 parts of trimellitic anhydride were added to 100.00 parts of the above monomer mixture, to obtain Polyester resin 1.

The obtained Polyester resin 1 had a peak molecular weight of 12000, a glass transition temperature (Tg) of 75° C., an acid value of 8.2 mgKOH/g, and an ester group concentration of 5.41 mmol/g.

Production Example of Powder Adhesive 1

| | |
|---|---|
| Styrene | 75.0 parts |
| n-butyl acrylate | 25.0 parts |
| Polyester resin 1 | 4.0 parts |
| Wax 1 | 14.0 parts |
| Wax 6 | 2.0 parts |
| Divinylbenzene (crosslinking agent) | 0.6 parts |

A mixture resulting from mixing the above materials was kept at 60° C., and was stirred at 500 rpm using T.K. Homomixer (by Tokushu Kika Kogyo Co., Ltd.), to elicit uniform dissolution and prepare a polymerizable monomer composition.

Meanwhile, 850.0 parts of a 0.10 mol/L-$Na_3PO_4$ aqueous solution and 8.0 parts of 10% hydrochloric acid were added into a vessel provided with a high-speed stirring device CLEARMIX (by M Technique Co. Ltd.), the revolutions were adjusted to 15000 rpm, and the temperature was raised to 70° C. Then 127.5 parts of a 1.0 mol/L-$CaCl_2$ aqueous solution were added thereto, to prepare an aqueous medium that contained a calcium phosphate compound.

The above polymerizable monomer composition was charged into the aqueous medium, followed by addition of 8.0 parts of t-butyl peroxypivalate as a polymerization initiator, and granulation for 10 minutes while keeping revolutions at 15000 rpm. Thereafter, the stirrer was changed from a high-speed stirrer to a propeller stirring blade, and the reaction was carried out at 70° C. for 5 hours while under reflux, after which the liquid temperature was adjusted to 85° C., and the reaction was left to proceed for a further 2 hours.

Once the polymerization reaction was over, the obtained slurry was cooled, and hydrochloric acid was further added to the slurry, to adjust the pH to 1.4, whereupon the mixture was stirred for 1 hour, to thereby dissolve a calcium phosphate salt. Thereafter, the slurry was washed with water in an amount thrice the amount of the slurry, with filtration and drying, followed by classifying to yield powder adhesive particles.

Thereafter, 2.0 parts of silica fine particles (number-average particle diameter of primary particles: 10 nm; BET specific surface area: 170 $m^2/g$) having undergone a hydrophobic treatment using dimethyl silicone oil (20 mass %) were added, as an external additive, to 100.0 parts of the powder adhesive particles, and the whole was mixed using a Mitsui Henschel mixer (by Mitsui Miike Engineering Corporation), at 3000 rpm for 15 minutes, to yield Powder adhesive 1.

Production Example of Powder Adhesives 2 to 11 and 13 to 22

Powder adhesives 2 to 11 and 13 to 22 were obtained in the same way as in the production example of Powder adhesive 1, but modifying herein the type of the waxes, the type and addition amount of the monomers, the addition amount of the crosslinking agent, and the addition amount of the polymerization initiator, as given in Table 2.

Production Example of Powder Adhesive 12

| | |
|---|---|
| Polyester resin 1 | 100.0 parts |
| Wax 1 | 14.0 parts |
| Wax 6 | 2.0 parts |

ized using a mechanical crusher (T-250, by Turbo Kogyo Co., Ltd.); the obtained finely pulverized powder was classified using a multi-grade classifier relying on the Coanda effect, to yield powder adhesive particles having a weight-average particle diameter (D4) of 5.8 μm.

Thereafter, 2.0 parts of silica fine particles (number-average particle diameter of primary particles: 10 nm; BET specific surface area: 170 $m^2/g$) having undergone a hydrophobic treatment using dimethyl silicone oil (20 mass %) were added, as an external additive, to 100.0 parts of the powder adhesive particles, and the whole was mixed using a Mitsui Henschel mixer (by Mitsui Miike Engineering Corporation), at 3000 rpm for 15 minutes, to yield Powder adhesive 12.

The physical characteristics of the obtained Powder adhesives 1 to 22 were measured in accordance with the above methods. The results are summarized in Table 3.

TABLE 2

| | Wax type 1 | | Wax type 2 | | Type and addition amount of monomer | | | | | | Crosslinking | Polymerization |
|---|---|---|---|---|---|---|---|---|---|---|---|---|
| | No | amount (parts) | No | amount (parts) | Monomer 1 | parts | Monomer 2 | parts | Monomer 3 | parts | agent (parts) | initiator (parts) |
| Powder adhesive 1 | Wax 1 | 14.0 | Wax 6 | 2.0 | St | 75.0 | BA | 25.0 | — | — | 0.6 | 8.0 |
| Powder adhesive 2 | Wax 2 | 14.0 | Wax 6 | 2.0 | St | 75.0 | BA | 25.0 | — | — | 0.2 | 10.0 |
| Powder adhesive 3 | Wax 3 | 14.0 | Wax 6 | 2.0 | St | 75.0 | BA | 25.0 | — | — | 0.2 | 10.0 |
| Powder adhesive 4 | Wax 1 | 10.0 | Wax 6 | 2.0 | St | 75.0 | BA | 25.0 | — | — | 1.5 | 6.0 |
| Powder adhesive 5 | Wax 4 | 14.0 | — | — | St | 75.0 | BA | 25.0 | — | — | 0.3 | 10.0 |
| Powder adhesive 6 | Wax 5 | 14.0 | — | — | St | 75.0 | BA | 25.0 | — | — | 0.6 | 8.0 |
| Powder adhesive 7 | Wax 1 | 7.5 | — | — | St | 75.0 | BA | 25.0 | — | — | 0.2 | 10.0 |
| Powder adhesive 8 | Wax 1 | 24.5 | — | — | St | 75.0 | BA | 25.0 | — | — | 0.6 | 8.0 |
| Powder adhesive 9 | Wax 1 | 6.8 | — | — | St | 75.0 | BA | 25.0 | — | — | 0.2 | 10.0 |
| Powder adhesive 10 | Wax 1 | 27.0 | — | — | St | 75.0 | BA | 25.0 | — | — | 0.6 | 8.0 |
| Powder adhesive 11 | Wax 1 | 14.0 | — | — | St | 75.0 | BA | 25.0 | — | — | 0.6 | 8.0 |
| Powder adhesive 12 | Wax 1 | 14.0 | Wax 6 | 2.0 | | | | | Pulverization | | | |
| Powder adhesive 13 | Wax 1 | 14.0 | Wax 6 | 2.0 | St | 85.0 | BA | 15.0 | — | — | 0.6 | 12.0 |
| Powder adhesive 14 | Wax 1 | 14.0 | Wax 6 | 2.0 | St | 87.0 | BA | 13.0 | — | — | 0.6 | 12.0 |
| Powder adhesive 15 | Wax 1 | 14.0 | Wax 6 | 2.0 | PhMA | 50.0 | BA | 45.0 | MA | 5.0 | 0.6 | 8.0 |
| Powder adhesive 16 | Wax 1 | 14.0 | Wax 6 | 2.0 | PhMA | 46.0 | BA | 52.0 | MA | 2.0 | 0.6 | 8.0 |
| Powder adhesive 17 | Wax 1 | 10.2 | — | — | St | 75.0 | BA | 25.0 | — | — | 0.2 | 10.0 |
| Powder adhesive 18 | Wax 1 | 9.0 | — | — | St | 75.0 | BA | 25.0 | — | — | 0.2 | 10.0 |
| Powder adhesive 19 | Wax 1 | 40.0 | Wax 6 | 32.0 | St | 75.0 | BA | 25.0 | — | — | 0.8 | 8.0 |
| Powder adhesive 20 | Wax 6 | 14.0 | — | — | St | 75.0 | BA | 25.0 | — | — | 0.2 | 20.0 |
| Powder adhesive 21 | Wax 7 | 14.0 | Wax 6 | 2.0 | St | 75.0 | BA | 25.0 | — | — | 0.2 | 20.0 |
| Powder adhesive 22 | Wax 1 | 10.0 | Wax 6 | 2.0 | St | 75.0 | BA | 25.0 | — | — | 1.5 | 5.0 |

The above materials were premixed in a Henschel mixer (by Nippon Coke & Engineering Co., Ltd.) and were then melt-kneaded in a twin-screw kneading extruder (by Ikegai Corp.: model PCM-30).

The obtained kneaded product was cooled, was coarsely pulverized using with a hammer mill, and was then pulver- The abbreviations for Monomer 1, Monomer 2, and Monomer 3 in the table are given below.

St: styrene

PhMA: phenyl methacrylate

BA: n-butyl acrylate

MA: methyl acrylate

TABLE 3

| | Gb' (100) (Pa) | Tg (° C.) | D4 (μm) | Peak molecular weight | Ester group concentration of thermoplastic resin B (mmol/g) | Content N of wax A (mass %) | Nb (mass %) |
|---|---|---|---|---|---|---|---|
| Powder adhesive 1 | $4.70 \times 10^3$ | 51 | 6.8 | 19000 | 1.95 | 10.4 | 12.0 |
| Powder adhesive 2 | $8.50 \times 10^3$ | 52 | 7.3 | 15000 | 1.95 | 10.4 | 12.0 |
| Powder adhesive 3 | $9.00 \times 10^3$ | 52 | 7.8 | 15000 | 1.95 | 10.4 | 12.0 |
| Powder adhesive 4 | $9.50 \times 10^4$ | 53 | 6.8 | 25000 | 1.95 | 8.0 | 9.6 |
| Powder adhesive 5 | $7.50 \times 10^3$ | 51 | 6.7 | 15000 | 1.95 | 10.4 | 10.4 |
| Powder adhesive 6 | $5.00 \times 10^3$ | 51 | 6.9 | 19000 | 1.95 | 10.4 | 10.4 |
| Powder adhesive 7 | $9.80 \times 10^3$ | 52 | 6.8 | 15000 | 1.95 | 6.0 | 6.0 |

TABLE 3-continued

| | Gb' (100) (Pa) | Tg (° C.) | D4 (μm) | Peak molecular weight | Ester group concentration of thermoplastic resin B (mmol/g) | Content N of wax A (mass %) | Nb (mass %) |
|---|---|---|---|---|---|---|---|
| Powder adhesive 8 | $1.50 \times 10^3$ | 51 | 6.8 | 19000 | 1.95 | 18.0 | 18.0 |
| Powder adhesive 9 | $1.05 \times 10^4$ | 52 | 6.7 | 15000 | 1.95 | 5.0 | 5.0 |
| Powder adhesive 10 | $1.10 \times 10^3$ | 51 | 6.8 | 19000 | 1.95 | 20.0 | 20.0 |
| Powder adhesive 11 | $5.00 \times 10^3$ | 51 | 6.7 | 19000 | 1.95 | 10.4 | 10.4 |
| Powder adhesive 12 | $1.00 \times 10^4$ | 59 | 5.8 | 12000 | 5.41 | 10.4 | 12.0 |
| Powder adhesive 13 | $1.10 \times 10^4$ | 60 | 6.8 | 12000 | 1.10 | 10.4 | 12.0 |
| Powder adhesive 14 | $1.20 \times 10^4$ | 61 | 6.8 | 13000 | 0.95 | 10.4 | 12.0 |
| Powder adhesive 15 | $7.00 \times 10^3$ | 54 | 6.8 | 16000 | 6.88 | 10.4 | 12.0 |
| Powder adhesive 16 | $5.00 \times 10^3$ | 53 | 6.8 | 15000 | 7.16 | 10.4 | 12.0 |
| Powder adhesive 17 | $8.00 \times 10^3$ | 52 | 6.7 | 15000 | 1.95 | 7.5 | 7.5 |
| Powder adhesive 18 | $8.50 \times 10^3$ | 52 | 6.8 | 15000 | 1.95 | 7.0 | 7.0 |
| Powder adhesive 19 | $1.50 \times 10^3$ | 51 | 6.9 | 19000 | 1.95 | 30.0 | 54.0 |
| Powder adhesive 20 | $8.00 \times 10^3$ | 50 | 6.8 | 9000 | 1.95 | 0 | 10.4 |
| Powder adhesive 21 | $7.50 \times 10^3$ | 50 | 6.7 | 9000 | 1.95 | 0 | 12.0 |
| Powder adhesive 22 | $1.20 \times 10^5$ | 54 | 6.8 | 30000 | 1.95 | 8.0 | 9.6 |

Production Example of Toner 1

| | |
|---|---|
| Styrene | 60.0 parts |
| Colorant | 6.5 parts |

(C.I. Pigment Blue 15:3, by Dainichiseika Color & Chemicals Mfg. Co., Ltd.)

The above materials were placed in an Attritor (by Mitsui Miike Engineering Corporation), and were dispersed at 220 rpm for 5 hours, using zirconia particles having a diameter of 1.7 mm, to yield a pigment dispersion.

| | |
|---|---|
| Styrene | 15.0 parts |
| n-butyl acrylate | 25.0 parts |
| Polyester resin 1 | 4.0 parts |
| Wax 6 | 12.0 parts |
| Divinylbenzene (crosslinking agent) | 0.25 parts |

The above materials were mixed and added to the pigment dispersion. The obtained mixture was kept at 60° C., and was stirred at 500 rpm using T.K. Homomixer (by Tokushu Kika Kogyo Co., Ltd.), to elicit uniform dissolution, and prepare a polymerizable monomer composition.

Meanwhile, 850.0 parts of a 0.10 mol/L-$Na_3PO_4$ aqueous solution and 8.0 parts of 10% hydrochloric acid were added into a vessel provided with a high-speed stirring device CLEARMIX (by M Technique Co. Ltd.), the revolutions were adjusted to 15000 rpm, and the temperature was raised to 70° C. Then 127.5 parts of a 1.0 mol/L-$CaCl_2$ aqueous solution were added thereto, to prepare an aqueous medium that contained a calcium phosphate compound.

The above polymerizable monomer composition was charged into the aqueous medium, followed by addition of 8.0 parts of t-butyl peroxypivalate as a polymerization initiator, and granulation for 10 minutes while keeping revolutions at 15000 rpm. Thereafter, the stirrer was changed from a high-speed stirrer to a propeller stirring blade, and the reaction was carried out at 70° C. for 5 hours while under reflux, after which the liquid temperature was adjusted to 85° C., and the reaction was left to proceed for a further 2 hours.

Once the polymerization reaction was over, the obtained slurry was cooled, and hydrochloric acid was further added to the slurry, to adjust the pH to 1.4, whereupon the mixture was stirred for 1 hour, to thereby dissolve a calcium phosphate salt. Thereafter, the slurry was washed with water in an amount thrice the amount of the slurry, with filtration and drying, followed by classifying to yield a toner particle.

Thereafter, 2.0 parts of silica fine particles (number-average particle diameter of primary particles: 10 nm; BET specific surface area: 170 $m^2/g$) having undergone a hydrophobic treatment using dimethyl silicone oil (20 mass %) were added, as an external additive, to 100.0 parts of the toner particle, and the whole was mixed using a Mitsui Henschel mixer (by Mitsui Miike Engineering Corporation), at 3000 rpm for 15 minutes, to yield Toner 1.

Production Example of Toners 2 to 11

Toners 2 to 11 were obtained in the same way as in the production example of Toner 1, but modifying herein the type of the wax, the addition amount of the crosslinking agent and the addition amount of the polymerization initiator, as given in Table 4.

TABLE 4

| | Wax | | Crosslinking | Polymerization |
|---|---|---|---|---|
| | No | amount (parts) | agent (parts) | initiator (parts) |
| Toner 1 | Wax 6 | 12.0 | 0.25 | 8.0 |
| Toner 2 | Wax 6 | 12.0 | 1.00 | 8.0 |
| Toner 3 | Wax 1 | 12.0 | 0.60 | 8.0 |
| Toner 4 | Wax 1 | 7.0 | 0.60 | 8.0 |
| Toner 5 | Wax 6 | 12.0 | 0.65 | 8.0 |
| Toner 6 | Wax 6 | 2.5 | 0.25 | 8.0 |
| Toner 7 | Wax 6 | 12.0 | 0.25 | 5.0 |
| Toner 8 | Wax 6 | 12.0 | 0.25 | 12.0 |
| Toner 9 | Wax 6 | 12.0 | 0.25 | 20.0 |
| Toner 10 | Wax 6 | 12.0 | 1.00 | 8.0 |
| Toner 11 | Wax 1 | 12.0 | 0.35 | 8.0 |

The physical characteristics of the obtained Toners 1 to 11 were measured in accordance with the methods described above. The results are summarized in Table 5.

TABLE 5

| | Gt' (100) (Pa) | Tg (° C.) | D4 (μm) | Peak molecular weight | Ester group concentration of thermoplastic resin A (mmol/g) | Na (mass %) |
|---|---|---|---|---|---|---|
| Toner 1 | $2.58 \times 10^4$ | 52 | 6.5 | 21000 | 1.95 | 9.0 |
| Toner 2 | $2.00 \times 10^5$ | 54 | 6.5 | 23000 | 1.95 | 9.0 |
| Toner 3 | $6.00 \times 10^3$ | 50 | 7.0 | 21000 | 1.95 | 9.0 |
| Toner 4 | $9.50 \times 10^3$ | 51 | 7.5 | 21000 | 1.95 | 5.0 |
| Toner 5 | $1.40 \times 10^5$ | 53 | 6.5 | 21000 | 1.95 | 9.0 |
| Toner 6 | $3.50 \times 10^4$ | 52 | 6.6 | 21000 | 1.95 | 2.0 |
| Toner 7 | $6.10 \times 10^4$ | 54 | 6.7 | 36000 | 1.95 | 9.0 |
| Toner 8 | $1.80 \times 10^4$ | 52 | 6.5 | 10000 | 1.95 | 9.0 |
| Toner 9 | $1.50 \times 10^4$ | 51 | 6.5 | 9000 | 1.95 | 9.0 |
| Toner 10 | $2.00 \times 10^5$ | 54 | 6.5 | 23000 | 1.95 | 9.0 |
| Toner 11 | $5.00 \times 10^3$ | 50 | 6.6 | 21000 | 1.95 | 9.0 |

Respective developer sets were prepared using the obtained powder adhesives and toners, in the combinations given in Table 6. Developer sets 1 to 25 were used as examples and Developer sets 26 to 29 were used as comparative examples.

TABLE 6

| | | Toner | | | | Powder adhesive | | | | Developer | | |
|---|---|---|---|---|---|---|---|---|---|---|---|---|
| | | No. | Gt'(100) (Pa) | Molecular weight (A) | Na (mass %) | No. | Gb'(100) (Pa) | Molecular weight (B) | Nb (mass %) | Gt'(100)/ Gb'(100) | B/A | Nb/Na |
| Example 1 | Developer set 1 | 1 | $2.58 \times 10^4$ | 21000 | 9.0 | 1 | $4.70 \times 10^3$ | 19000 | 12.0 | 5.49 | 0.90 | 1.33 |
| Example 2 | Developer set 2 | 1 | $2.58 \times 10^4$ | 21000 | 9.0 | 2 | $8.50 \times 10^3$ | 15000 | 12.0 | 3.04 | 0.71 | 1.33 |
| Example 3 | Developer set 3 | 1 | $2.58 \times 10^4$ | 21000 | 9.0 | 3 | $9.00 \times 10^3$ | 15000 | 12.0 | 2.87 | 0.71 | 1.33 |
| Example 4 | Developer set 4 | 2 | $2.00 \times 10^5$ | 23000 | 9.0 | 4 | $9.50 \times 10^4$ | 25000 | 9.6 | 2.11 | 1.09 | 1.07 |
| Example 5 | Developer set 5 | 3 | $6.00 \times 10^3$ | 21000 | 9.0 | 1 | $4.70 \times 10^3$ | 19000 | 12.0 | 1.28 | 0.90 | 1.33 |
| Example 6 | Developer set 6 | 4 | $9.50 \times 10^3$ | 21000 | 5.0 | 1 | $4.70 \times 10^3$ | 19000 | 12.0 | 2.02 | 0.90 | 2.40 |
| Example 7 | Developer set 7 | 5 | $1.40 \times 10^5$ | 21000 | 9.0 | 1 | $4.70 \times 10^3$ | 19000 | 12.0 | 29.79 | 0.90 | 1.33 |
| Example 8 | Developer set 8 | 1 | $2.58 \times 10^4$ | 21000 | 9.0 | 5 | $7.50 \times 10^3$ | 15000 | 10.4 | 3.44 | 0.71 | 1.16 |
| Example 9 | Developer set 9 | 1 | $2.58 \times 10^4$ | 21000 | 9.0 | 6 | $5.00 \times 10^3$ | 19000 | 10.4 | 5.16 | 0.90 | 1.16 |
| Example 10 | Developer set 10 | 6 | $3.50 \times 10^4$ | 21000 | 2.0 | 7 | $9.80 \times 10^3$ | 15000 | 6.0 | 3.57 | 0.71 | 3.00 |
| Example 11 | Developer set 11 | 1 | $2.58 \times 10^4$ | 21000 | 9.0 | 8 | $1.50 \times 10^3$ | 19000 | 18.0 | 17.20 | 0.90 | 2.00 |
| Example 12 | Developer set 12 | 6 | $3.50 \times 10^4$ | 21000 | 2.0 | 9 | $1.05 \times 10^4$ | 15000 | 5.0 | 3.33 | 0.71 | 2.50 |
| Example 13 | Developer set 13 | 1 | $2.58 \times 10^4$ | 21000 | 9.0 | 10 | $1.10 \times 10^3$ | 19000 | 20.0 | 23.45 | 0.90 | 2.22 |
| Example 14 | Developer set 14 | 1 | $2.58 \times 10^4$ | 21000 | 9.0 | 11 | $5.00 \times 10^3$ | 19000 | 10.4 | 5.16 | 0.90 | 1.16 |
| Example 15 | Developer set 15 | 1 | $2.58 \times 10^4$ | 21000 | 9.0 | 12 | $1.00 \times 10^4$ | 12000 | 12.0 | 2.58 | 0.57 | 1.33 |
| Example 16 | Developer set 16 | 1 | $2.58 \times 10^4$ | 21000 | 9.0 | 13 | $1.10 \times 10^4$ | 12000 | 12.0 | 2.35 | 0.57 | 1.33 |
| Example 17 | Developer set 17 | 1 | $2.58 \times 10^4$ | 21000 | 9.0 | 14 | $1.20 \times 10^4$ | 13000 | 12.0 | 2.15 | 0.62 | 1.33 |
| Example 18 | Developer set 18 | 1 | $2.58 \times 10^4$ | 21000 | 9.0 | 15 | $7.00 \times 10^3$ | 16000 | 12.0 | 3.69 | 0.76 | 1.33 |
| Example 19 | Developer set 19 | 1 | $2.58 \times 10^4$ | 21000 | 9.0 | 16 | $5.00 \times 10^3$ | 15000 | 12.0 | 5.16 | 0.71 | 1.33 |
| Example 20 | Developer set 20 | 7 | $6.10 \times 10^4$ | 36000 | 9.0 | 1 | $4.70 \times 10^3$ | 19000 | 12.0 | 12.98 | 0.53 | 1.33 |
| Example 21 | Developer set 21 | 8 | $1.80 \times 10^4$ | 10000 | 9.0 | 1 | $4.70 \times 10^3$ | 19000 | 12.0 | 3.83 | 1.90 | 1.33 |
| Example 22 | Developer set 22 | 9 | $1.50 \times 10^4$ | 9000 | 9.0 | 1 | $4.70 \times 10^3$ | 19000 | 12.0 | 3.19 | 2.11 | 1.33 |
| Example 23 | Developer set 23 | 1 | $2.58 \times 10^4$ | 21000 | 9.0 | 17 | $8.00 \times 10^3$ | 15000 | 7.5 | 3.23 | 0.71 | 0.83 |
| Example 24 | Developer set 24 | 1 | $2.58 \times 10^4$ | 21000 | 9.0 | 18 | $8.50 \times 10^3$ | 15000 | 7.0 | 3.04 | 0.71 | 0.78 |
| Example 25 | Developer set 25 | 1 | $2.58 \times 10^4$ | 21000 | 9.0 | 19 | $1.50 \times 10^3$ | 19000 | 54.0 | 17.20 | 0.90 | 6.00 |
| Example 26 | Developer set 26 | 7 | $6.10 \times 10^4$ | 36000 | 9.0 | 14 | $1.20 \times 10^4$ | 13000 | 12.0 | 5.08 | 0.36 | 1.33 |
| Comparative example 1 | Developer set 26 | 1 | $2.58 \times 10^4$ | 21000 | 9.0 | 20 | $8.00 \times 10^3$ | 9000 | 10.4 | 3.23 | 0.43 | 1.16 |
| Comparative example 2 | Developer set 27 | 1 | $2.58 \times 10^4$ | 21000 | 9.0 | 21 | $7.50 \times 10^3$ | 9000 | 12.0 | 3.44 | 0.43 | 1.33 |
| Comparative example 3 | Developer set 28 | 10 | $2.00 \times 10^5$ | 23000 | 9.0 | 22 | $1.20 \times 10^5$ | 30000 | 9.6 | 1.67 | 1.30 | 1.07 |
| Comparative example 4 | Developer set 29 | 11 | $5.00 \times 10^3$ | 21000 | 9.0 | 1 | $4.70 \times 10^3$ | 19000 | 12.0 | 1.06 | 0.90 | 1.33 |

The performance of the obtained Developer sets 1 to 29 was evaluated in accordance with the following methods. All evaluations were performed in a normal-temperature, normal-humidity environment (25° C./50% RH); the paper used was A4 size GFC-081 (81.0 g/m$^2$) (by Canon Marketing Japan Inc.). The results are given in Table 7.

Evaluation of Adhesive Strength and Hot Offset Resistance Production of a Sample Image for Evaluation A sample image for evaluation was produced using a commercially available Canon laser beam printer LBP712Ci. The printer was altered, using a software modification, so as to operate even when none of the cartridges was set. The laid-on levels (mg/cm$^2$) of the powder adhesive and of the toner were set to be adjustable as desired.

The toner contained in the cyan cartridge of LBP712Ci was removed, and the cartridge was filled with 150 g of toner of each respective developer set, and was and set in the cyan station. Further, the toner contained in the black cartridge was removed, and the cartridge was filled with 150 g of the powder adhesive of each respective developer set, and was set in the black station.

Figure 8:
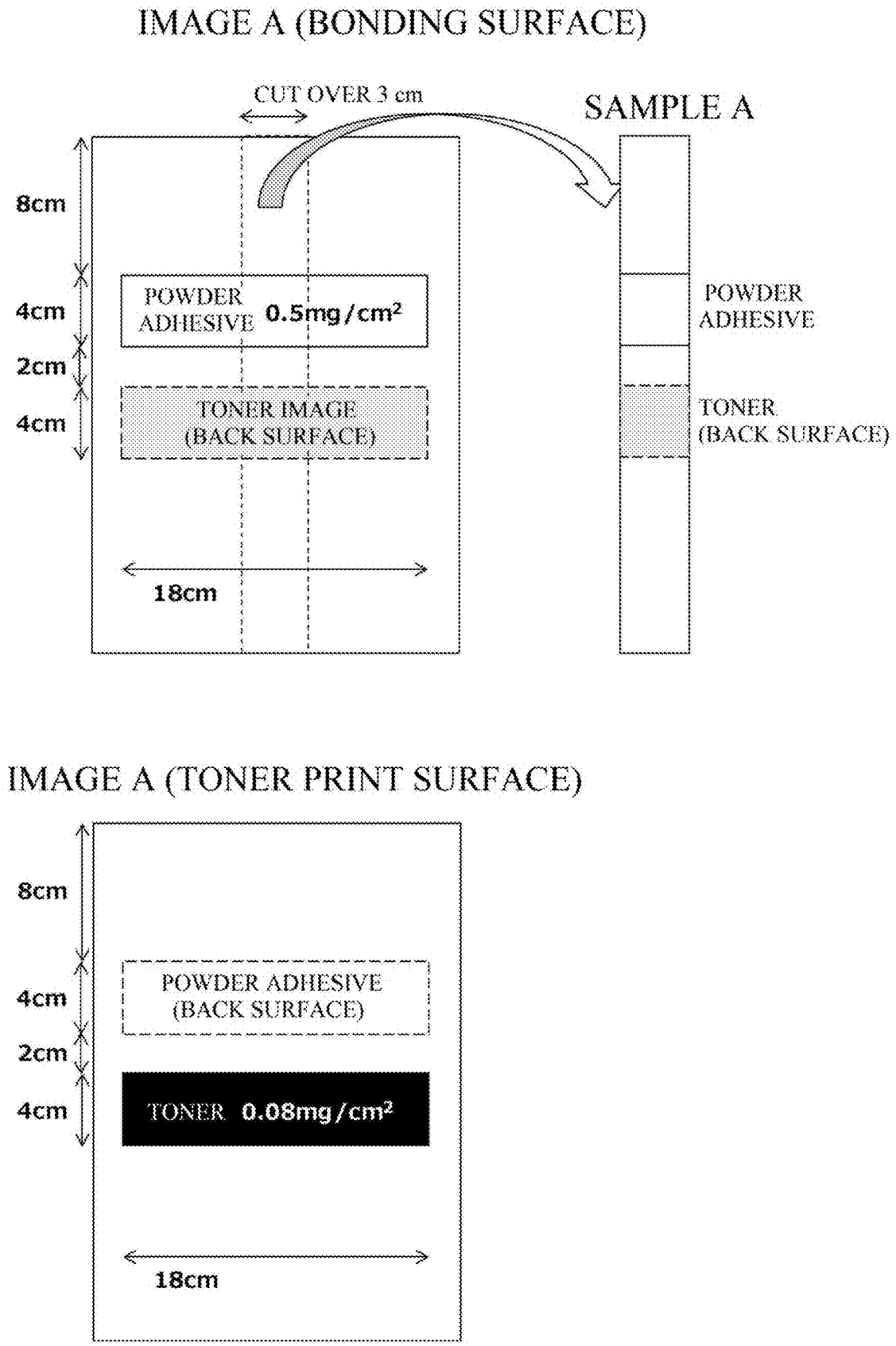
FIG. 8 is a schematic diagram of an evaluation sample.

Using this printer, the powder adhesive was printed, at a laid-on level of 0.5 mg/cm$^2$, on a 4 cm region of one face (constituting a bonding surface) of the paper, leaving a leading-end margin of 8 cm, while on the surface (constituting the toner print surface) on the reverse side from that where the powder adhesive was formed there was printed toner (image A) at a laid-on level of 0.08 mg/cm$^2$ on a 4 cm region, leaving a margin of 14 cm, as illustrated in FIG. 8.

Figure 9:
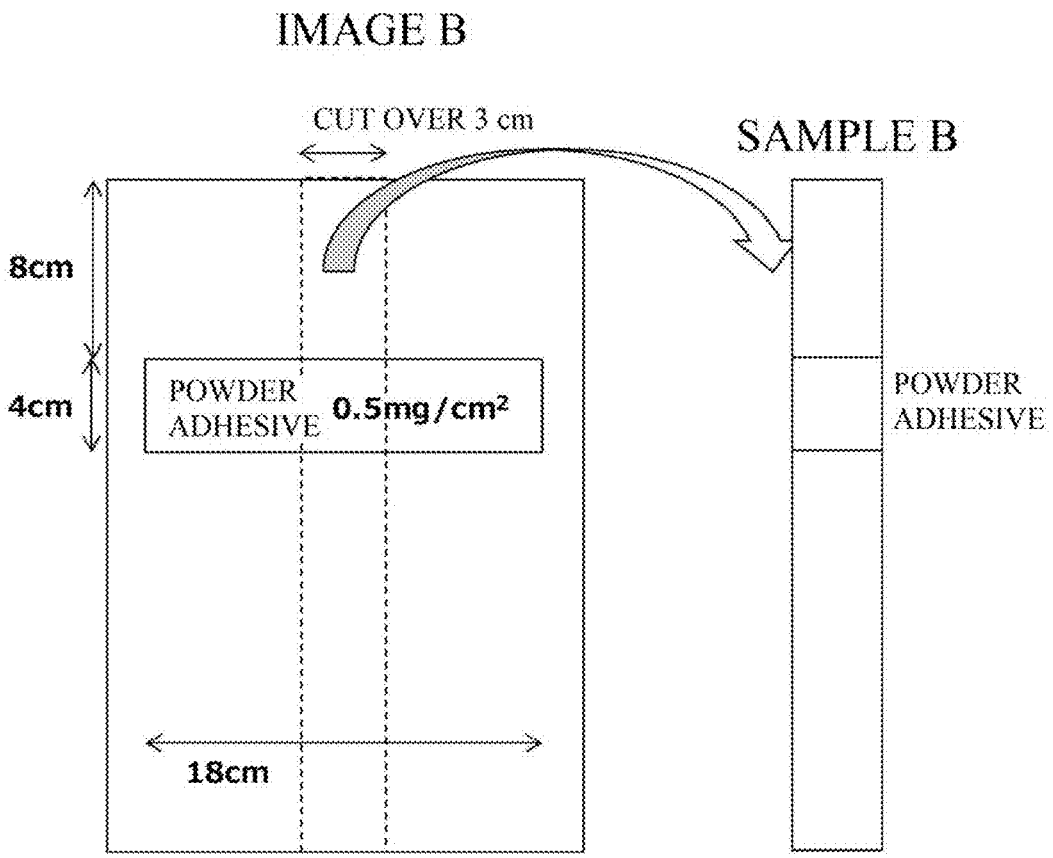
FIG. 9 is a schematic diagram of an evaluation sample.

Further, as illustrated in FIG. 9, a powder adhesive was printed at a laid-on level of 0.5 mg/cm$^2$ (image B) on a 4 cm region of another paper sheet, while leaving a leading-end margin of 8 cm.

The obtained image A was cut to a width of 3 cm, to obtain sample A. Similarly, image B was cut to obtain sample B.

Evaluation of the Bonding Temperature of the Powder Adhesive

Figure 10:
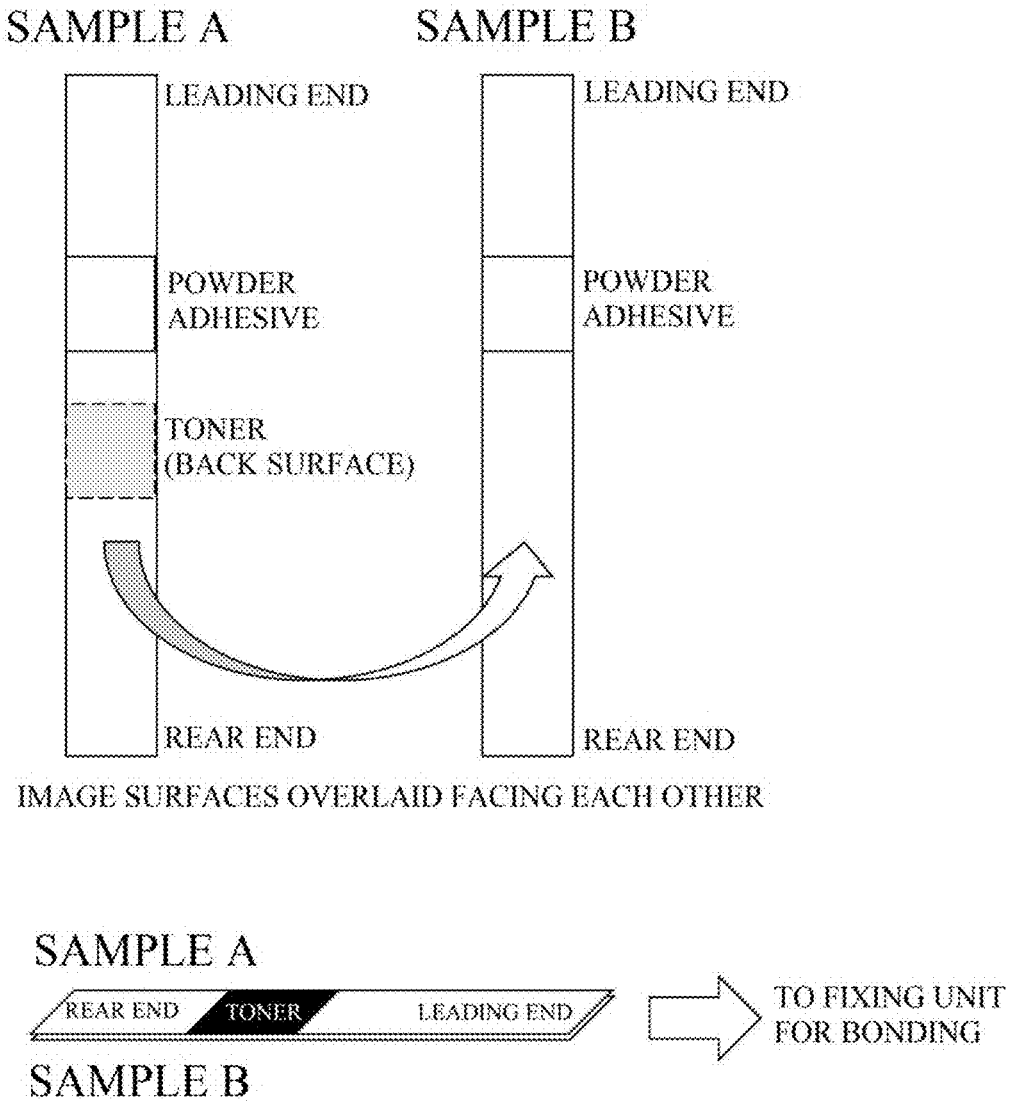
FIG. 10 is a schematic diagram of an evaluation sample.
Figure 11:
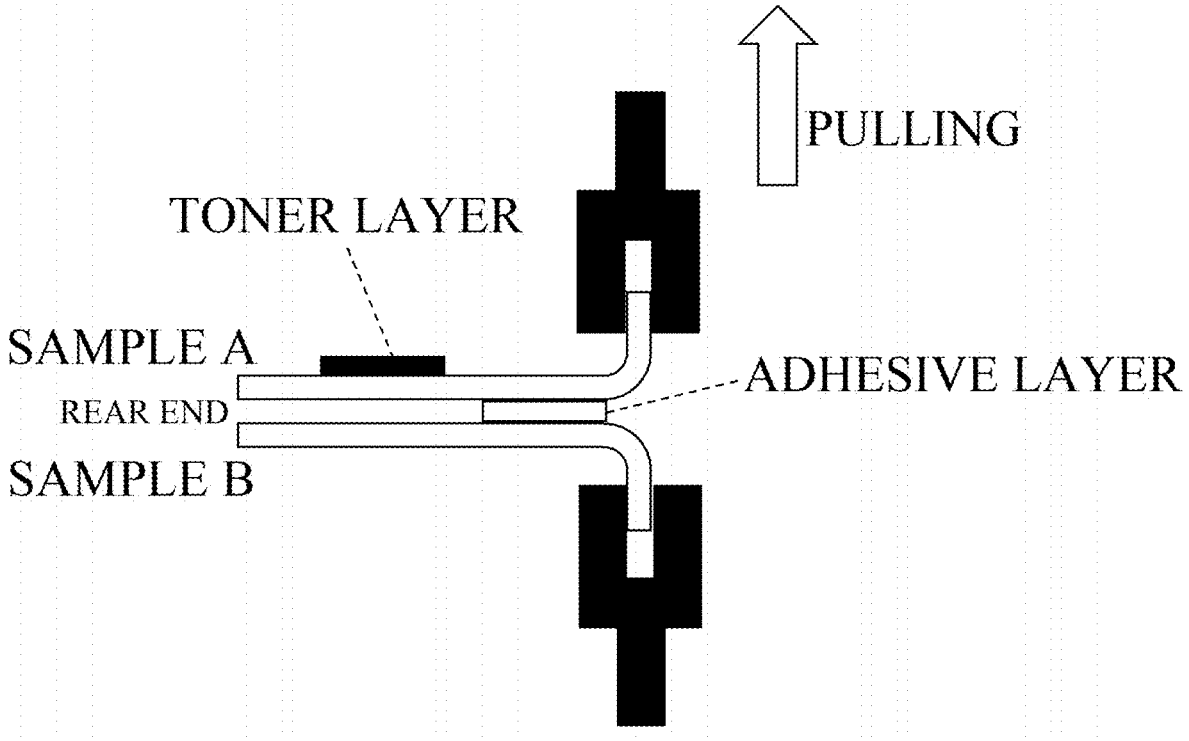
FIG. 11 is a schematic diagram of adhesive strength evaluation.

As illustrated in FIG. 10, sample A and sample B were disposed opposing each other so that the powder adhesive side was facing inward, and the samples were caused to pass through an external fixing unit removed from the LBP712Ci, with the sample A side facing upward; the adhesive strength of the powder adhesive and the hot offset resistance of the toner were then evaluated.

Specifically, a plurality of sets of sample A and sample B were prepared and caused to pass through the external fixing unit, while modifying the set temperature of the external fixing unit in increments of 2° C. In the below-described method for evaluating adhesive strength, the minimum set temperature of the fixing unit at which the adhesive strength of the powder adhesive was 1.2 (N/cm$^2$) was evaluated as the bonding temperature. The lower the bonding temperature, the better becomes bonding strength at low temperature.

The maximum set temperature of the fixing unit at which toner hot offset occurs was evaluated as a hot offset resistance temperature. The higher the hot offset resistance temperature, the better hot offset resistance is. A method for evaluating the hot offset property will be explained below.

The greater the fixing region that is set, being the difference between the bonding temperature and the hot offset resistance temperature, the larger a fixing margin becomes and the better the developer set is.

Evaluation of Hot Offset Property

When sample A and sample B are disposed opposing each other so that the powder adhesive side faces inward and the samples are caused to pass through a fixing unit, with sample A side facing upward, hot offset occurs, whereupon and toner having undergone hot offset becomes printed on the paper, downstream of the toner print portion.

The component of the toner derived from hot offset and printed on the paper was measured, to evaluate hot offset resistance. A reflectometer ("REFLECTOMETER MODEL TC-6DS" by Tokyo Denshoku Co., Ltd.) was used for measuring density. The reflectance Dr (%) of the toner portion derived from offset on the paper and the reflectance Ds (%) of a white background portion of the paper were measured, and a calculation was performed in accordance with the expression below.

$$\text{Toner density derived from hot offset (\%)} = Dr(\%) - Ds(\%)$$

Herein the maximum fixing unit set temperature at which the above value of toner density did not exceed 0.4 was taken as the hot offset resistance temperature.

Evaluation of Durability

An image having a print percentage of 1% was outputted in 15000 prints, using a printer having the above-mentioned toners and powder adhesives. After output of the image, the cartridge filled with the powder adhesive was taken out and disassembled, and the number of vertical streaks appearing on the developing roller was ascertained using an optical microscope. A smaller number of vertical streaks entails a lower likelihood of member contamination, and enhanced durability.

Evaluation of Storability

Blocking resistance was assessed to evaluate stability during storage. The evaluation was conducted for each of the toner and powder adhesive of the developer sets given in Table 6.

Herein about 5 g of toner were placed in a 100 mL resin-made cup, and the cup was allowed to stand for 10 days in an environment at a temperature of 50° C. and humidity of 20%, after which the degree of aggregation of the toner was measured as follows and was evaluated according to the following criteria.

As the measuring device there was used a digital-display vibrometer "Digivibro MODEL 1332A" (by Showa Sokki Corporation) connected to a side of the vibrating table of a "Powder Tester" (by Hosokawa Micron Corporation). The following sieves were stacked sequentially from bottom to top, on the vibrating table of the Powder Tester: a sieve with a mesh opening of 38 μm (400 mesh), a sieve with a mesh opening of 75 μm (200 mesh) and a sieve with a mesh opening of 150 μm (100 mesh). The measurement was carried out in an environment at 25° C. and 50% RH, as follows.

(1) The vibrational amplitude of the vibrating table was adjusted beforehand so that the displacement in the digital-display vibrometer took on a value of 0.60 mm (peak-to-peak).

(2) The toner having been allowed to stand for 10 days was then left to stand beforehand for 24 hours in an environment at 23° C. and 60% RH, whereupon 5 g of the toner were weighed exactly and gently placed on the 150 μm-opening sieve at the uppermost stage.

(3) The sieves were caused to vibrate for 15 seconds, after which the mass of the toner remaining on each sieve was measured; the degree of agglomeration was then calculated based on the expression below.

$$\text{Degree of agglomeration (\%)} = \{(\text{sample mass (g) on sieve with opening of 150 μm})/5\ (g)\} \times 100 + \{(\text{sample mass (g) on sieve with opening of 75 μm})/5\ (g)\} \times 100 \times 0.6 + \{(\text{sample mass (g) on sieve with opening of 38 μm})/5\ (g)\} \times 100 \times 0.2$$

It was deemed that the lower the numerical value of degree of agglomeration, the higher is the blocking resistance denoted thereby.

The powder adhesive was also evaluated in the same manner as the toner; in combinations of the developer sets given in Table 6, the higher numerical value of degree of agglomeration from among the toner and powder adhesive of each developer set was taken used as the evaluation of storability of that developer set.

TABLE 7

| | | Combination of hot offset resistance and adhesiveness | | | | Storability |
|---|---|---|---|---|---|---|
| | | Bonding temperature of powder adhesive (° C.) | Hot offset resistance temperature of toner (° C.) | Fixing region (° C.) | Durability Streaks (number) | Degree of agglomeration (%) |
| Example 1 | Developer set 1 | 194 | 230 | 36 | 0 | 10 |
| Example 2 | Developer set 2 | 208 | 230 | 22 | 3 | 12 |
| Example 3 | Developer set 3 | 215 | 230 | 15 | 5 | 14 |
| Example 4 | Developer set 4 | 220 | 245 | 25 | 0 | 11 |
| Example 5 | Developer set 5 | 194 | 213 | 19 | 0 | 12 |
| Example 6 | Developer set 6 | 194 | 220 | 26 | 0 | 12 |
| Example 7 | Developer set 7 | 194 | 238 | 44 | 0 | 13 |
| Example 8 | Developer set 8 | 205 | 230 | 25 | 1 | 25 |
| Example 9 | Developer set 9 | 194 | 230 | 36 | 0 | 26 |
| Example 10 | Developer set 10 | 216 | 236 | 20 | 0 | 22 |
| Example 11 | Developer set 11 | 182 | 230 | 48 | 0 | 29 |
| Example 12 | Developer set 12 | 219 | 236 | 17 | 0 | 21 |
| Example 13 | Developer set 13 | 180 | 230 | 50 | 0 | 33 |
| Example 14 | Developer set 14 | 194 | 230 | 36 | 0 | 27 |
| Example 15 | Developer set 15 | 202 | 230 | 28 | 0 | 22 |
| Example 16 | Developer set 16 | 206 | 230 | 24 | 0 | 17 |
| Example 17 | Developer set 17 | 211 | 230 | 19 | 0 | 16 |
| Example 18 | Developer set 18 | 187 | 230 | 43 | 0 | 28 |
| Example 19 | Developer set 19 | 185 | 230 | 45 | 0 | 34 |
| Example 20 | Developer set 20 | 194 | 240 | 46 | 0 | 11 |
| Example 21 | Developer set 21 | 194 | 213 | 19 | 0 | 15 |
| Example 22 | Developer set 22 | 194 | 207 | 13 | 0 | 16 |
| Example 23 | Developer set 23 | 208 | 230 | 22 | 0 | 23 |
| Example 24 | Developer set 24 | 212 | 230 | 18 | 0 | 22 |
| Example 25 | Developer set 25 | 182 | 230 | 48 | 0 | 32 |
| Example 26 | Developer set 26 | 211 | 240 | 29 | 0 | 16 |
| Comparative example 1 | Developer set 26 | 224 | 230 | 6 | 6 | 13 |
| Comparative example 2 | Developer set 27 | 220 | 230 | 10 | 7 | 15 |
| Comparative example 3 | Developer set 28 | 245 | 250 | 5 | 0 | 12 |
| Comparative example 4 | Developer set 29 | 194 | 205 | 11 | 0 | 12 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-130489, filed Jul. 31, 2020 which is hereby incorporated by reference herein in its entirety.

What is claimed is:

1. An electrophotographic developer set comprising a toner, and a powder adhesive, wherein the toner comprises a thermoplastic resin A, the powder adhesive comprises a thermoplastic resin B and a wax A, the wax A has two or more ester groups in a molecule, the thermoplastic resin B has an ester group, and in a viscoelasticity measurement, with Gt'(100) (Pa) being a storage elastic modulus at 100° C. of the toner, and Gb'(100) (Pa) being a storage elastic modulus at 100° C. of the powder adhesive, Gb'(100) is $1.00\times10^5$ Pa or less, and Gt'(100)/Gb'(100) is 1.20 or more.

2. The electrophotographic developer set according to claim 1, wherein the Gt'(100)/Gb'(100) is 2.00 to 30.00.

3. The electrophotographic developer set according to claim 1, wherein the wax A has a molecular weight of 300 to 1000.

4. The electrophotographic developer set according to claim 1, wherein the wax A comprises at least one selected from the group consisting of an ester wax represented by formula (1) and an ester wax represented by formula (2):

(1)

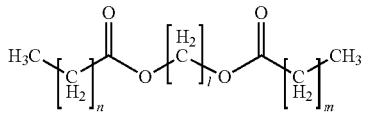

(2)

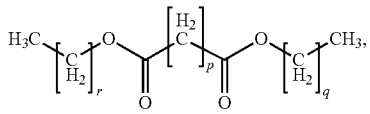

where, in the formula (1), l represents a positive integer of 2 to 12, and n and m each independently represents a positive integer of 12 to 20, and in the formula (2), p represents a positive integer of 2 to 10, and q and r each independently represents a positive integer of 11 to 21.

5. The electrophotographic developer set according to claim 4, wherein the wax A comprises the ester wax represented by the formula (1), and in the formula (1), l represents 2, and n and m each independently represents a positive integer of 14 to 20.

6. The electrophotographic developer set according to claim 1, wherein a content N of the wax A in the powder adhesive is 6.0 to 18.0 mass %.

7. The electrophotographic developer set according to claim 1, wherein the powder adhesive further contains a wax B; and the wax B is a linear saturated hydrocarbon wax having a peak carbon number of 20 to 70.

8. The electrophotographic developer set according to claim 1, wherein the thermoplastic resin B is a styrene acrylic resin or a polyester resin.

9. The electrophotographic developer set according to claim 1, wherein an ester group concentration in the thermoplastic resin B is 1.00 to 7.00 mmol/g.

10. The electrophotographic developer set according to claim 1, wherein

B/A is 0.50 to 2.00, where

A denotes a peak molecular weight of a main peak in a molecular weight distribution of a tetrahydrofuran-soluble fraction of the toner; and B denotes a peak molecular weight of a main peak in a molecular weight distribution of a tetrahydrofuran-soluble fraction of the powder adhesive.

11. The electrophotographic developer set according to claim 1, wherein the toner further comprises a wax; and Nb/Na is 0.80 to 6.00, where Na (mass %) denotes a content of total wax in the toner, and Nb (mass %) denotes a content of total wax in the powder adhesive.

12. The electrophotographic developer set according to claim 1, wherein the Gt'(100) is $5.00\times10^3$ to $2.00\times10^5$ Pa.

13. The electrophotographic developer set according to claim 1, wherein the thermoplastic resin A is a styrene acrylic resin.

14. A method for producing a bonded product resulting from bonding at least one sheet of paper via an adhesive portion by using an electrophotographic developer set, wherein the electrophotographic developer set comprises a toner, and a powder adhesive, wherein the toner comprises a thermoplastic resin A, the powder adhesive comprises a thermoplastic resin B and a wax A, the wax A has two or more ester groups in a molecule, the thermoplastic resin B has an ester group, and in a viscoelasticity measurement, with Gt'(100) (Pa) being a storage elastic modulus at 100° C. of the toner, and Gb'(100) (Pa) being a storage elastic modulus at 100° C. of the powder adhesive, Gb'(100) is $1.00\times10^5$ Pa or less, and Gt'(100)/Gb'(100) is 1.20 or more, and wherein the bonded product has a surface A on which an adhesive portion of the powder adhesive is fixed, and a surface B on which a toner image portion of the toner is fixed, the surface B being a surface different from the surface A, the method comprising the following steps, in no particular order:

forming the toner image portion on the surface B, and fixing the toner image portion on the surface B by heating; and forming the adhesive portion on the surface A, and fixing the adhesive portion on the surface A by heating, wherein the method further comprises the following steps, after the forming and the fixing of the toner image portion and the adhesive portion:

overlaying the paper so as to interpose the adhesive portion, and melting the adhesive portion thereby bonding the paper to obtain the bonded product.

* * * * *